US011354960B2

(12) United States Patent
Tokiwa

(10) Patent No.: US 11,354,960 B2
(45) Date of Patent: Jun. 7, 2022

(54) INTERMEDIARY SERVER, REMOTE CONTROL SYSTEM, AND MEDIATING METHOD

(71) Applicant: Masafumi Tokiwa, Fukuoka (JP)

(72) Inventor: Masafumi Tokiwa, Fukuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/346,587

(22) Filed: Jun. 14, 2021

(65) Prior Publication Data

US 2021/0398378 A1 Dec. 23, 2021

(30) Foreign Application Priority Data

Jun. 17, 2020 (JP) ..... JP2020-104742

(51) Int. Cl.
*G07C 9/27* (2020.01)
*G07C 9/00* (2020.01)

(52) U.S. Cl.
CPC ..... *G07C 9/27* (2020.01); *G07C 9/00309* (2013.01); *G07C 2009/00769* (2013.01)

(58) Field of Classification Search
CPC ..... G07C 9/27; G07C 9/00309; G07C 2009/00769
See application file for complete search history.

(56) References Cited

U.S. PATENT DOCUMENTS

2012/0280789 A1* 11/2012 Gerhardt ..... H04L 63/0428 340/5.61
2013/0059603 A1* 3/2013 Guenec ..... G07C 9/00904 455/456.2
2015/0199863 A1* 7/2015 Scoggins ..... G07C 9/00571 340/5.25
2016/0044472 A1* 2/2016 Person ..... G06Q 10/02 705/5

FOREIGN PATENT DOCUMENTS

JP 10-292689 11/1998

* cited by examiner

*Primary Examiner* — Nabil H Syed
(74) *Attorney, Agent, or Firm* — IPUSA, PLLC

(57) ABSTRACT

An intermediary server includes circuitry to receive, from a reservation management server, resource identification information for identifying a resource. The reservation management server manages a reservation for the resource and receives the reservation from a registration terminal that registers the reservation. The circuitry further transmits, to a drive control server, drive device identification information for identifying a drive device corresponding to the resource identification information. The drive control server remotely controls the drive device used to unlock the resource. The circuitry further receives, from the drive control server, authentication information to be used to unlock the resource with the drive device identified by the drive device identification information. The circuitry further receives, transmit, to the registration terminal, the authentication information.

9 Claims, 24 Drawing Sheets

FIG. 6

RESERVATION INFORMATION

| RESERVATION ID | RESERVATION-MAKING USER ACCOUNT | EVENT NAME | RESOURCE ID | START DATE AND TIME | END DATE AND TIME | EXPECTED PARTICIPANT ACCOUNT |
|---|---|---|---|---|---|---|
| R001 | a@xfood.com | REGULAR MEETING | K001 | 2020/4/1 9:00 | 2020/4/1 10:00 | b@xfood.com c@xfood.com |
| R001 | e@xfood.com | PRODUCT DEVELOPMENT MEETING | K001 | 2020/4/1 10:00 | 2020/4/1 11:00 | f@xfood.com g@xfood.com |
| ... | ... | ... | ... | ... | ... | ... |

FIG. 7A

| ORGANIZATION ID | USER ACCOUNT | USER NAME |
|---|---|---|
| G001 | a@xfood.com | USER a |
| ... | ... | ... |

FIG. 7B

RESERVATION INFORMATION

| RESERVATION ID | RESERVATION-MAKING USER ACCOUNT | EVENT NAME | RESOURCE ID | START DATE AND TIME | END DATE AND TIME | EXPECTED PARTICIPANT ACCOUNT | EVENT STATUS |
|---|---|---|---|---|---|---|---|
| R001 | a@xfood.com | REGULAR MEETING | K001 | 2020/4/1 9:00 | 2020/4/1 10:00 | b@xfood.com c@xfood.com | AUTHENTICATION INFORMATION HAS BEEN INFORMED |
| R001 | e@xfood.com | PRODUCT DEVELOPMENT MEETING | K001 | 2020/4/1 10:00 | 2020/4/1 11:00 | f@xfood.com g@xfood.com | WAITING FOR START |
| ... | ... | ... | ... | ... | ... | ... | ... |

FIG. 7C

| ORGANIZATION ID | RESOURCE NAME | RESOURCE ID | KEY TYPE | DRIVE DEVICE ID | ACCESS/LOCATION |
|---|---|---|---|---|---|
| G001 | CONFERENCE ROOM A | K001 | ELECTRONIC KEY | d001 | https://:····· |
| | CONFERENCE ROOM B | K002 | PHYSICAL KEY | d002 | 1F SECURITY ROOM |
| | CONFERENCE ROOM C | K003 | NONE | d003 | |
| | CONFERENCE ROOM D | K004 | ELECTRONIC KEY | d004 | https://:····· |
| ... | ... | ... | ... | ... | ... |

FIG. 8

| DRIVE DEVICE ID | DRIVE DEVICE DESTINATION INFORMATION | AUTHENTI-CATION INFORMA-TION | VALID PERIOD OF AUTHENTICATION INFORMATION | STATUS OF DRIVE DEVICE |
|---|---|---|---|---|
| d001 | 111.222.333.444 | **** | 2020/4/1 9:00-10:00 | UNLOCKED |
| d001 | 111.222.333.444 | **** | 2020/4/1 10:00-11:00 | LOCKED |
| ... | ... | ... | ... | ... |

FIG. 14

-User who made reservation: Mr./Ms. User A

The authentication code required to use the resource (Conference Room A) is "6917"
The code is valid for the following period of time.

-Reservation Information

Event Name Regular Meeting

Start Time 2020/4/1 9:00

End Time 2020/4/1 10:00

FIG. 16

-User who made reservation: Mr./Ms. User A

The key for the resource (Conference Room A) is in Security Room on 1st floor.

-Reservation Information

Event Name Regular Meeting

Start Time 2020/4/1 9:00

End Time 2020/4/1 10:00

FIG. 18

-User who made reservation: Mr./Ms. User A

No key is required to use the resource (Conference Room A).

-Reservation Information

Event Name Regular Meeting

Start Time 2020/4/1 9:00

End Time 2020/4/1 10:00

INTERMEDIARY SERVER, REMOTE CONTROL SYSTEM, AND MEDIATING METHOD

CROSS-REFERENCE TO RELATED APPLICATIONS

This patent application is based on and claims priority pursuant to 35 U.S.C. § 119(a) to Japanese Patent Application No. 2020-104742, filed on Jun. 17, 2020, in the Japan Patent Office, the entire disclosure of which is hereby incorporated by reference.

BACKGROUND

Technical Field

The present disclosure relates to an intermediary server, a remote control system, and a mediating method.

Related Art

In recent years, a system for remotely unlocking (or locking) a resource with a smart lock by remotely controlling the smart lock from a smartphone via a server has been provided. Such a smart lock allows a user to unlock or lock a door of a shared resource, such as a meeting room in an office or a vehicle used for a car sharing service, in addition to a door of a privately owned resource, such as a door of a house or an apartment.

SUMMARY

An exemplary embodiment of the present disclosure includes an intermediary server including circuitry to receive, from a reservation management server, resource identification information for identifying a resource. The reservation management server manages a reservation for the resource and receives the reservation from a registration terminal that registers the reservation. The circuitry further transmits, to a drive control server, drive device identification information for identifying a drive device corresponding to the resource identification information. The drive control server remotely controls the drive device used to unlock the resource. The circuitry further receives, from the drive control server, authentication information to be used to unlock the resource with the drive device identified by the drive device identification information. The circuitry further receives, transmit, to the registration terminal, the authentication information.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 6 is a conceptual diagram illustrating a reservation management table according to one or more embodiments of the disclosure;

FIG. 7A is a conceptual diagram illustrating a user management table according to one or more embodiments of the disclosure;

FIG. 7B is a conceptual diagram illustrating an event management table according to one or more embodiments of the disclosure;

FIG. 7C is a conceptual diagram illustrating a key type management table according to one or more embodiments of the disclosure;

FIG. 8 is a conceptual diagram illustrating a drive device management table according to one or more embodiments of the disclosure;

FIG. 14 is an illustration of an example screen displayed on a PC when a key type is indicated as "ELECTRONIC KEY" according to one or more embodiments of the disclosure;

FIG. 16 is an illustration of an example screen displayed on a PC when the key type is indicated as "PHYSICAL KEY", according to one or more embodiments of the disclosure;

FIG. 18 is an illustration of an example screen displayed on a PC when a key type is indicated as "NONE", according to one or more embodiments of the disclosure;

Figure 1:
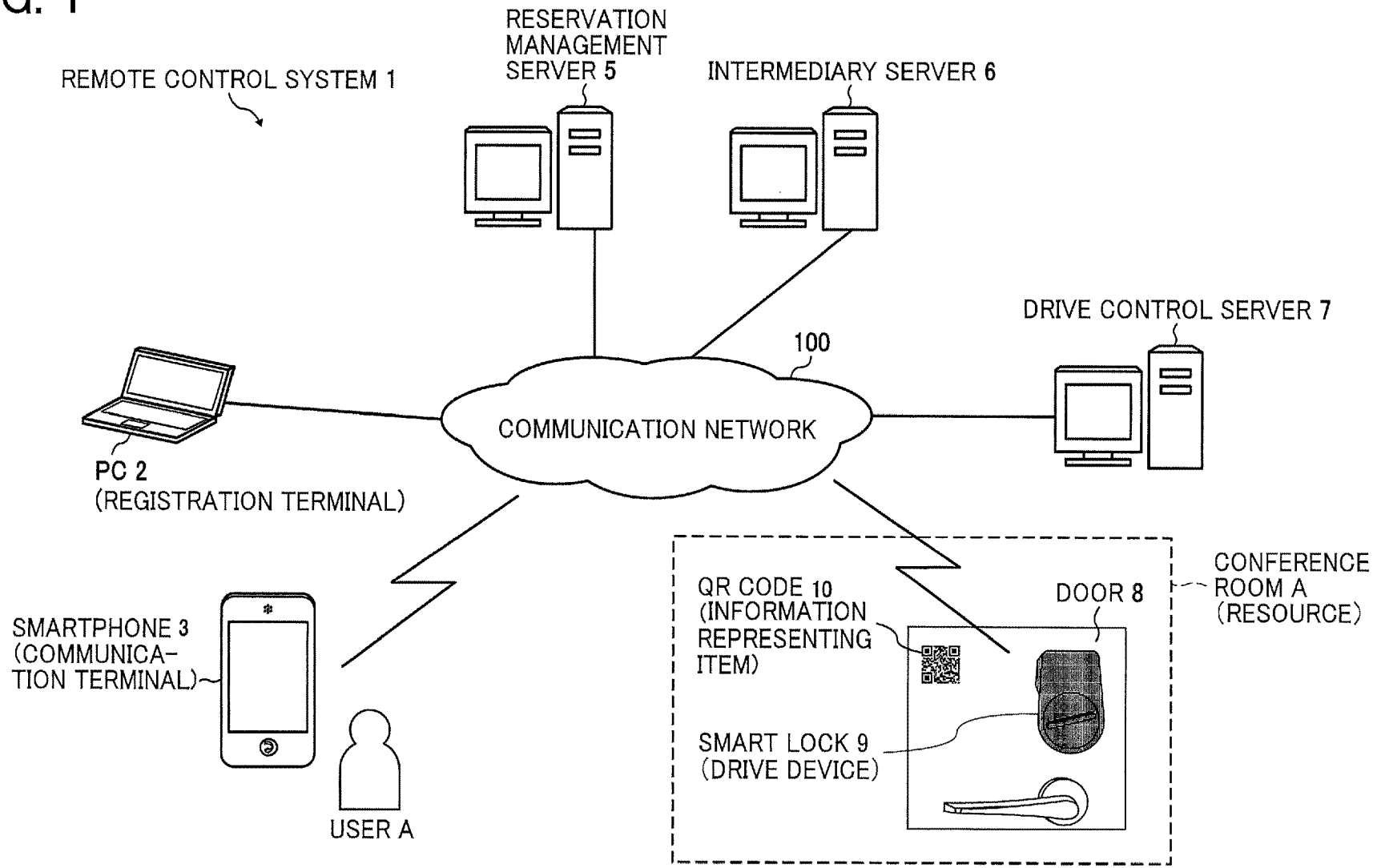
FIG. 1 is a schematic view of a remote control system according to one or more embodiments of the disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

The terminology used herein is for the purpose of describing particular embodiments only and is not intended to be limiting of the present invention. As used herein, the singular forms "a," "an," and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Embodiments of the present disclosure are described in detail below, with reference to the drawings.

Overview of System:

A description is given below of an overview of a remote control system 1 according to an exemplary embodiment. FIG. 1 is a schematic view of the remote control system 1 according to the present embodiment. In the description of the present embodiment, a case where a smartphone 3 remotely unlocks or locks a smart lock 9 set outside a door 8 of a resource such as Conference Room (Meeting Room) A (outside Conference Room A) is described.

As illustrated in FIG. 1, the remote control system 1 includes a personal computer (PC) 2, the smartphone 3, a reservation management server 5, an intermediary server 6, a drive control server 7, and the smart lock 9. The above-described elements communicate each other via a communication network 100 such as the Internet. The communication network 100 may include not only a wired communication network but also a wireless communication network such as a mobile communication system (4G, 5G, 6G, etc.) and Worldwide Interoperability for Microwave Access (WiMAX).

The PC 2, the smartphone 3, and the smart lock 9 are owned by the same business operator (organization) such as a company. Hereinafter, as an example of the organization, a company is used in the description of the embodiment. There are Conference Room A, Conference Room B, and Conference Room C in a building of the company. In FIG. 1, Conference Room A is illustrated. A sticker on which QR CODE is printed is affixed to an outer surface of the door 8 of Conference Room A (the outside of conference room A). QR CODE printed on the sticker is embedded with resource identification information (ID) (for example, resource ID) for identifying Conference Room A and access destination information (access location information, access/location information).

The PC 2 is, for example, a laptop PC used by User A, and is an example of a registration terminal used by User A to register his or her schedules or reservations for resources (resource reservations) in the reservation management server 5.

The smartphone 3 is an example of a (mobile) communication terminal carried by User A.

The smart lock 9 is installed in a key portion of the door 8 and has a mechanism capable of unlocking and locking the door 8. Further, QR CODE (registered trademark) 10 such as a barcode is indicated on or near by the door 8. QR CODE 10 is printed on the sticker to be sticked on the door 8. QR CODE 10 is embedded with the resource ID for identifying a resource, such as a conference room for which the door 8 is installed, and the access destination information (for example, Uniform Resource Locator (URL)) in relation to the intermediary server 6. The sticker indicating QR CODE 10 is attached to a part of the resource such as the door 8 to associate QR CODE 10 and the resource. The smartphone 3 installed with an application of a QR CODE scanner acquires QR CODE information by the QR CODE scanner.

The smart lock 9 is an example of a drive device provided by the company that operates the drive control server 7 to an organization (company) to which User A belongs. In a case of a smart lock for a door, the smart lock 9 is attached to a thumb turn of the door 8, and the smart lock 9 rotates the thumb turn by being remotely operated to unlock or lock the door 8.

The reservation management server 5, the intermediary server 6, and the drive control server 7 are individually managed by different companies. The reservation management server 5 is, for example, a server of MICROSOFT (registered trademark) 365. The intermediary server 6 is, for example a server managed by a service provider that provides a service in which a reservation management service, such as MICROSOFT (registered trademark) 365, and a remote unlocking (or locking) service of the smart lock 9 are associated and cooperated with each other. The drive control server 7 is a server provided by the company that sells the smart lock 9 and provides the remote unlocking (or locking) service.

The company that manages the reservation management server 5 and the company that manages the drive control server 7 are different from each other, so that the intermediary server 6 mediates the processing between the reservation management server 5 and the drive control server 7.

Hardware Configuration:

A description is given below of an example of a hardware configuration of each device included in the remote control system 1 with reference to FIG. 2 to FIG. 4.

Figure 2:
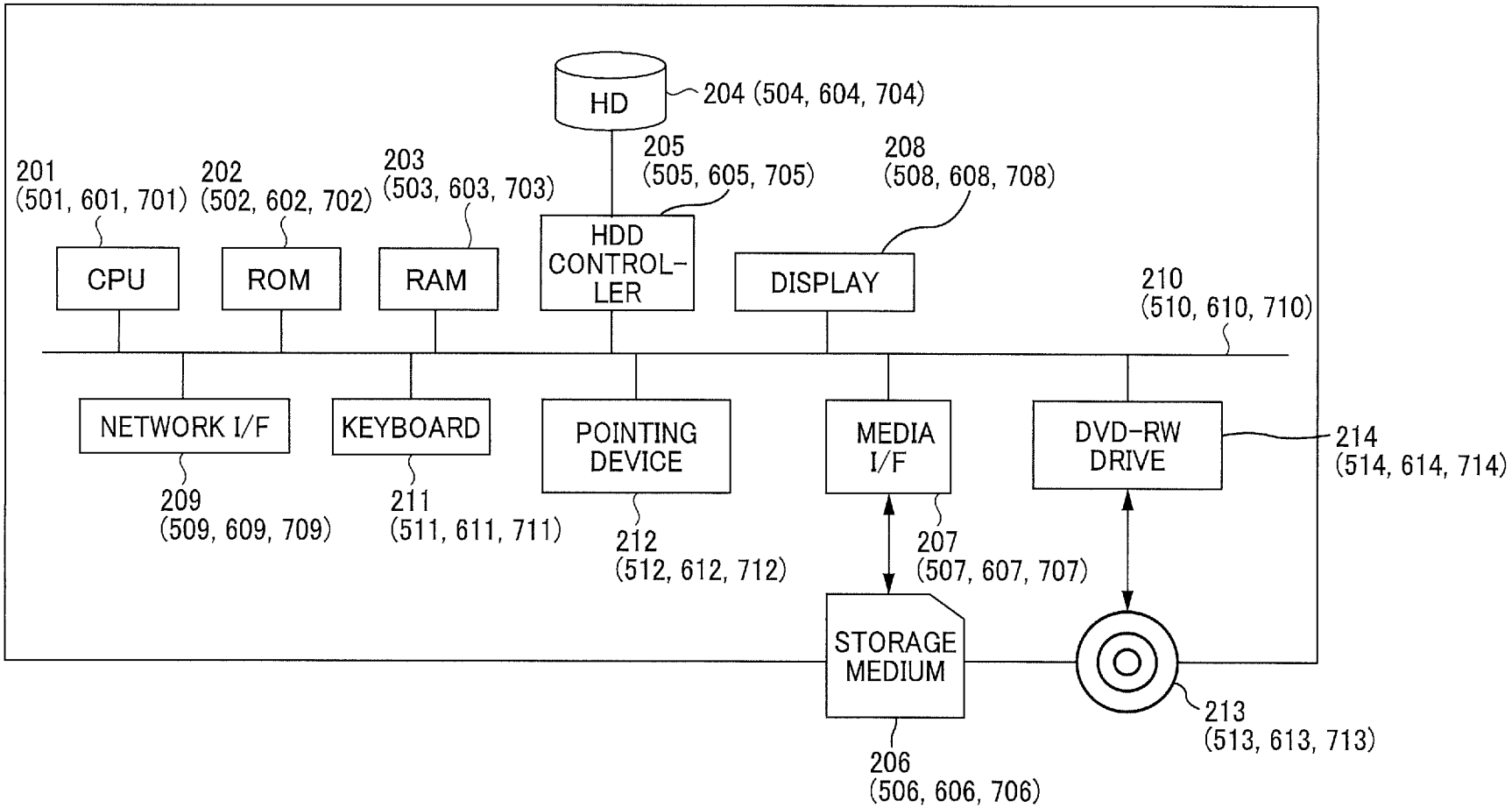
FIG. 2 is a block diagram illustrating a hardware configuration of a personal computer (PC), a reservation management server, an intermediary server, or a drive control server according to one or more embodiments of the disclosure.

Hardware configurations of PC or Each Server:

FIG. 2 is a block diagram illustrating a hardware configuration of a PC, a reservation management server, an intermediary server, or a drive control server according to the present embodiment. The hardware configuration of the PC 2 is indicated by a 200 number. Each hardware configuration of the reservation management server 5, the intermediary server 6, or the drive control server 7 is the same as that of the PC 2. The hardware configurations of the reservation management server 5, the intermediary server 6, and the drive control server 7 are indicated by a 500 number, a 600 number, and a 700 number, respectively.

The PC 2 is implemented by a computer, and includes as illustrated in FIG. 2, a central processing unit (CPU) 201, a read only memory (ROM) 202, a random access memory (RAM) 203, a hard disk (HD) 204, a hard disk drive (HDD) controller 205, a display 208, a network interface (I/F) 209, a data bus 210, a keyboard 211, a mouse (pointing device) 212, a media I/F 207, and a Digital Versatile Disk Rewritable (DVD-RW) drive 214.

The CPU 201 controls entire operation of the PC 2. The ROM 202 stores a program such as an initial program loader (IPL) used for driving the CPU 201. The RAM 203 is used as a work area for the CPU 201. The HD 204 stores various data such as a control program. The HDD controller 205 reads or writes various data from or to the HD 204 under control of the CPU 201. The display 208 displays various types of information such as a cursor, a menu, a window, characters, or an image. The network I/F 209 is an interface for data communication by using the communication network 100. The data bus 210 is an address bus or a data bus that electrically connects the elements illustrated in FIG. 2, such as the CPU 201, to each other.

The keyboard 211 is an example of an input device provided with a plurality of keys for allowing a user to input characters, numerals, or various instructions. The mouse 212 is one example of input device for selecting or executing various kinds of instructions, selecting an object to be processed, or for moving a cursor. The media I/F 207 reads or writes (stores) data from or to a recording medium 206 such as a flash memory or the like. The DVD-RW drive 214 reads or writes various data from or to a DVD-RW 213, which is an example of a removable storage medium. The removable storage medium is not limited to the DVD-RW and may be a digital versatile disc-recordable (DVD-R) or Blu-ray Disc.

Figure 3:
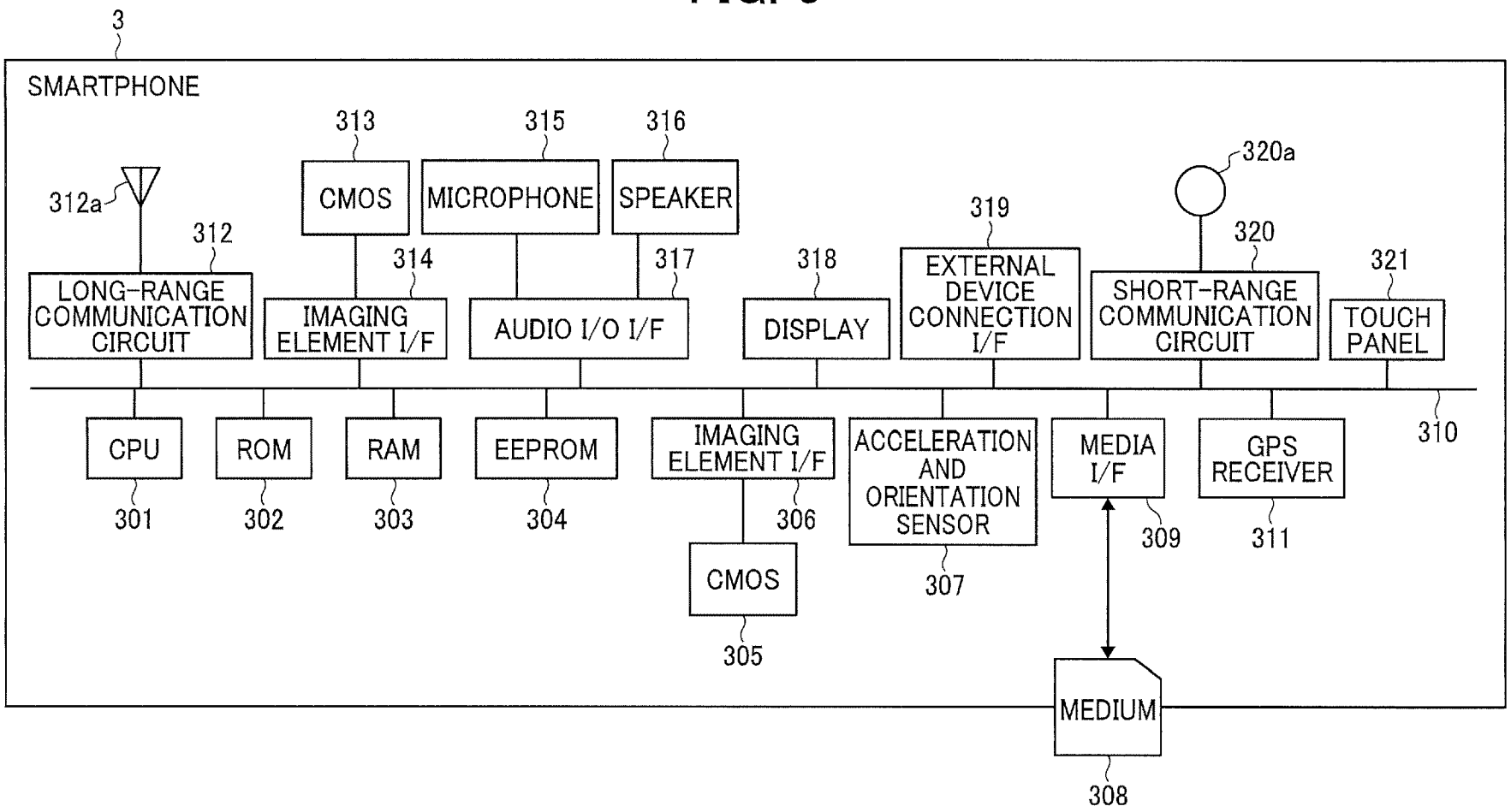
FIG. 3 is a block diagram illustrating a hardware configuration of a smartphone according to one or more embodiments of the disclosure.

Hardware Configuration of Smartphone:

FIG. 3 is a block diagram illustrating a hardware configuration of a smartphone according to the present embodiment. As illustrated in FIG. 3, the smartphone 3 includes a CPU 301, a ROM 302, a RAM 303, an electrically erasable PROM (EEPROM) 304, a Complementary Metal Oxide Semiconductor (CMOS) sensor 305, an imaging element I/F 306, an acceleration and orientation sensor 307, a media I/F 309, and a global positioning system (GPS) receiver 311.

The CPU 301 controls entire operation of the smartphone 3. The ROM 302 stores a program such as an IPL used for driving the CPU 301. The RAM 303 is used as a work area for the CPU 301. The EEPROM 304 reads or writes various data such as a control program for a smartphone under control of the CPU 301. The CMOS sensor 305 is an example of a built-in imaging device that captures an object (mainly, a self-image of a user operating the smartphone 3) under control of the CPU 301 to obtain image data. In alternative to the CMOS sensor, an imaging element such as a charge-coupled device (CCD) sensor may be used. The imaging element I/F 306 is a circuit that drives the CMOS sensor 305. The acceleration and orientation sensor 307 includes various sensors such as an electromagnetic compass or gyrocompass for detecting geomagnetism and an acceleration sensor. The media I/F 309 reads or writes (stores) data from or to a recording medium 308 such as a flash memory or the like. The GPS receiver 311 receives a GPS signal from a GPS satellite.

The smartphone 3 further includes a long-range communication circuit 312, an antenna 312*a* for the long-range communication circuit 312, a CMOS sensor 313, an imaging element I/F 314, a microphone 315, a speaker 316, an audio input/output (I/O) I/F 317, a display 318, an external device connection I/F 319, a short-range communication circuit 320, an antenna 320*a* for the short-range communication circuit 320, and a touch panel 321.

The long-range communication circuit 312 is a circuit that enables the smartphone 3 to communicate with other devices through the communication network 100. The CMOS sensor 313 is an example of a built-in imaging device capable of capturing a subject under control of the CPU 301. The imaging element I/F 314 is a circuit that drives the CMOS sensor 313. The microphone 315 is a built-in circuit that converts sound into an electric signal. The speaker 316 is a built-in circuit that generates audio such as music or voice by converting an electric signal into physical vibration. The audio I/O I/F 317 is a circuit for controlling input and output of audio signals between the microphone 315 and the speaker 316 under control of the CPU 301. The display 318 is an example of a display device that displays an image of the object, various icons, etc. Examples of the display 318 include a Liquid Crystal Display (LCD) and an organic Electro Luminescence (EL) display. The external device connection I/F 319 is an interface for connecting to various external devices. The short-range communication circuit 320 is a communication circuit that communicates in compliance with the Near Field Communication (NFC), the Bluetooth, or the like. The touch panel 321 is an example of an input device that allows a user to operate the smartphone 3 by touching a screen of the display 318.

The smartphone 3 further includes a bus line 310. The bus line 310 is an address bus or a data bus, which electrically connects the hardware resources illustrated in FIG. 3 such as the CPU 301.

Figure 4:
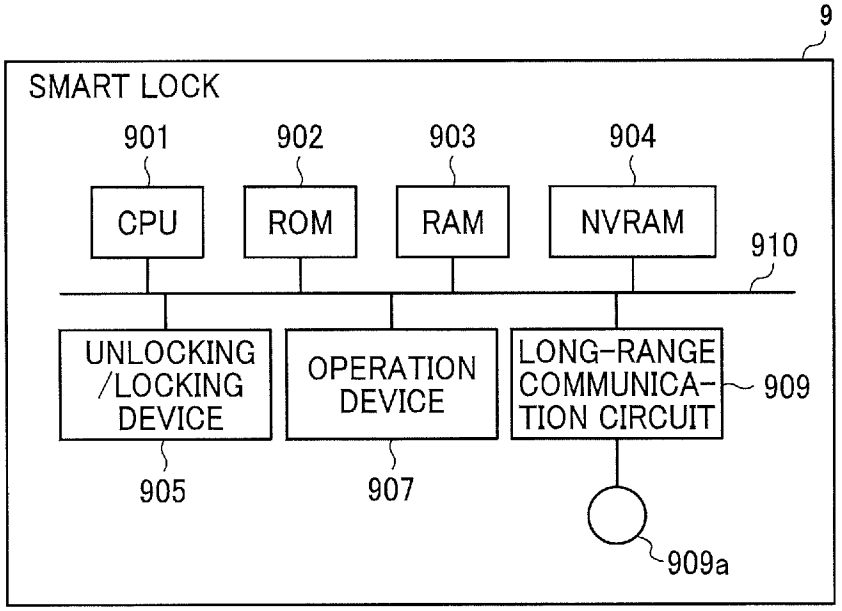
FIG. 4 is a block diagram illustrating a hardware configuration of a smart lock according to one or more embodiments of the disclosure.

Hardware Configuration of Smart Lock:

FIG. 4 is a block diagram illustrating a hardware configuration of a smart lock according to the present embodiment. The smart lock 9 is provided with a computer. As illustrated in FIG. 4, the smart lock 9 includes a CPU 901, a ROM 902, a RAM 903, a non-volatile random access memory (NVRAM) 904, an unlocking/locking device 905, an operation device 907, a long-range communication circuit 909, an antenna 909*a* for the long-range communication circuit 909, and a bus line 910.

The CPU 901 controls entire operation of the smart lock 9. The ROM 902 stores a program such as an IPL used for driving the CPU 901. The RAM 903 is used as a work area for the CPU 901. The NVRAM 904 is a non-volatile memory that stores or reads various data such as a program.

The unlocking/locking device 905 is a mechanism that is attached to the thumb turn of the door 8 and unlocks or locks the door 8 by rotating the thumb turn by being remotely controlled, or remotely operated. The operation device 907 is a part that is operated by a user. Examples of the operation device 907 includes a switch. The long-range communication circuit 909 is a communication circuit for performing data communication with the drive control server 7 via a communication network. The bus line 910 is, for example, an address bus or a data bus, which electrically connects the components such as the CPU 901 illustrated in FIG. 4.

Figure 5:
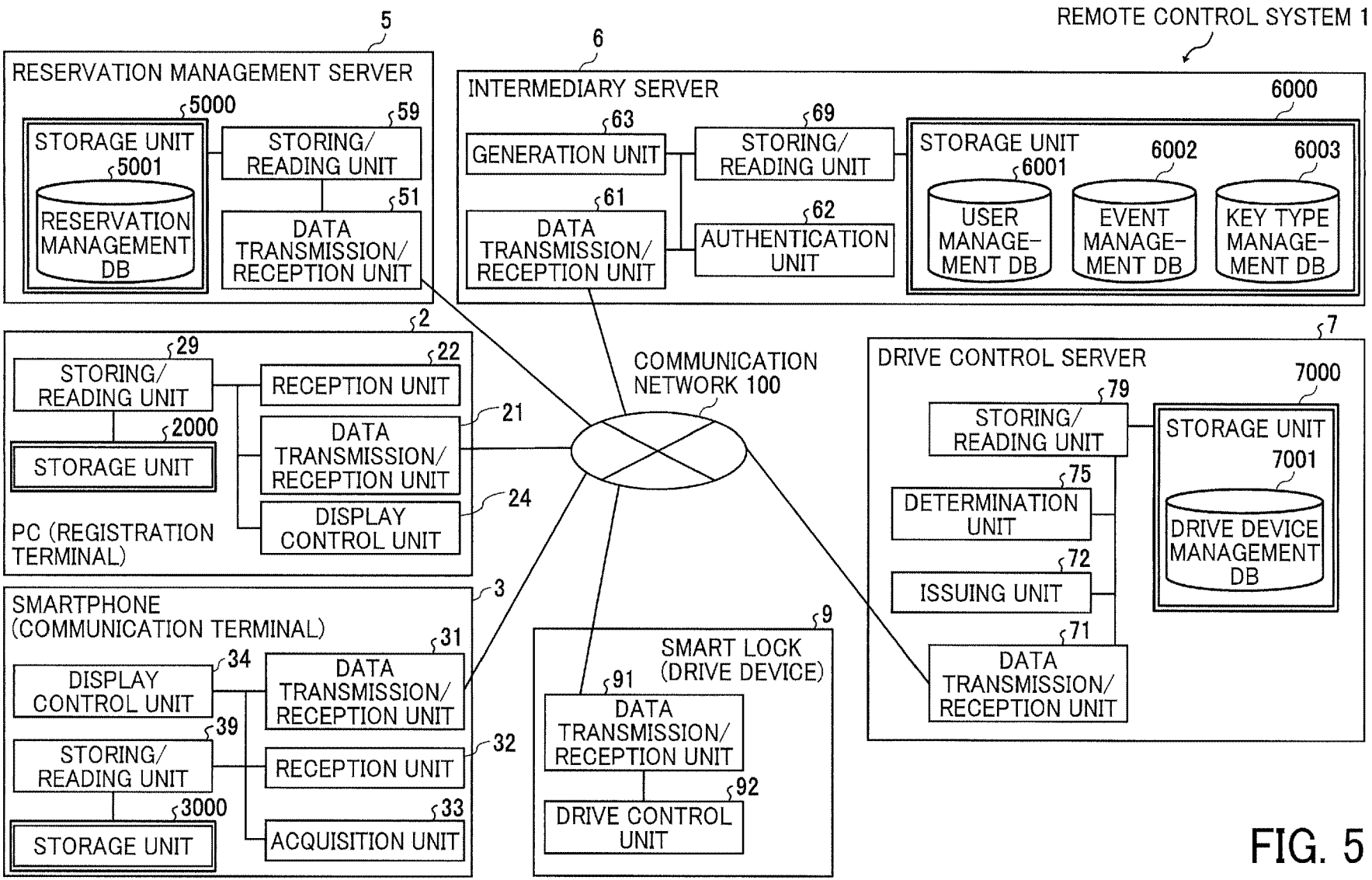
FIG. 5 is a block diagram illustrating a functional configuration of devices included in a remote control system according to one or more embodiments of the disclosure.

Functional Configuration:

A description is given below of an example of a functional configuration of each device included in the remote control system 1 with reference to FIG. 5 to FIG. 8. FIG. 5 is a block diagram illustrating a functional configuration of the devices included in the remote control system 1 according to the present embodiment.

Functional Configuration of PC:

As illustrated in FIG. 5, the PC 2 includes a data transmission/reception unit 21, a reception unit 22, a display control unit 24, and a storing/reading unit 29. These units are caused to function by operating one or more hardware components illustrated in FIG. 2 in cooperation with instructions of the CPU 201 according to the control program for the PC loaded from the ROM 202 to the RAM 203.

The PC 2 further includes a storage unit 2000, which is implemented by the ROM 202, the RAM 203, or the HD 204 illustrated in FIG. 2.

Functional Units of PC:

The data transmission/reception unit 21 of the PC 2, which is implemented by the processing of the CPU 201 with respect to the network I/F 209, transmits or receives various data (or information) to or from other devices via the communication network 100.

The reception unit 22, which is implemented mainly by the processing of the CPU 201 with respect to the keyboard 211 or the mouse 212, receives various selections or inputs from a use.

The display control unit 24 is implemented mainly by processing of the CPU 201 and displays various images on the display 208.

The storing/reading unit 29, which is mainly implemented by processing of the CPU 201, stores various data (or information) in the storage unit 2000 or reads various data (or information) from the storage unit 2000.

Functional Configuration of Smartphone:

As illustrated in FIG. 5, the smartphone 3 includes a data transmission/reception unit 31, a reception unit 32, an acquisition unit 33, a display control unit 34, and a storing/reading unit 39. These units are caused to function by operating one or more hardware components illustrated in FIG. 5 in cooperation with instructions of the CPU 301 according to the control program for the smartphone loaded from the EEPROM 304 to the RAM 303.

The smartphone 3 further includes a storage unit 3000, which is implemented by the ROM 302, the RAM 303, or the EEPROM 304 illustrated in FIG. 3.

Functional Units of Smartphone:

The data transmission/reception unit 31 of the smartphone 3, which is implemented mainly by the processing of the CPU 301 with respect to the long-range communication circuit 312, transmits or receives various data (or information) to or from other devices via the communication network 100.

The reception unit 32, which is mainly implemented by the processing of the CPU 301 with respect to the touch panel 321, receives various selections or inputs from a user.

The acquisition unit 33, which is mainly implemented by the processing of the CPU 301 with respect to the imaging element I/F 314 and processing of the CPU 301, causes the CMOS 313 to capture an image of QR CODE, and acquires data embedded in QR CODE from the captured image.

The display control unit 34 is implemented mainly by processing of the CPU 301 and displays various images on the display 318.

The storing/reading unit 39, which is mainly implemented by processing of the CPU 301, stores various data (or information) in the storage unit 3000 or reads various data (or information) from the storage unit 3000.

Functional Units of Reservation Management Server:

As illustrated in FIG. 5, the reservation management server 5 includes a data transmission/reception unit 51, and a storing/reading unit 59. These units are caused to function by operating one or more hardware components illustrated in FIG. 2 in cooperation with instructions of the CPU 501 according to the control program for the reservation management server loaded from the HD 504 to the RAM 503.

The reservation management server 5 further includes a storage unit 5000, which is implemented by the ROM 502 or the HD 504 illustrated in FIG. 2.

Reservation Management Table:

FIG. 6 is a conceptual diagram illustrating a reservation management table according to the present embodiment. The reservation management table is a table for managing the schedules of users and resource reservations including a reservation for a conference room. The storage unit 5000 stores a reservation management database (DB) 5001 including the reservation management table as illustrated in FIG. 6. The reservation management table manages one or more records each including data items of reservation ID, reservation-making user account, event name, resource ID, start date and time, end date and time, and expected participant account, which are associated with each other.

The reservation ID is an example of reservation identification information for identifying a specific reservation. The reservation-making user account is an account of a reservation-making user who has reserved (has made a reservation for) a resource such as the conference room for use. In a record of the reservation ID of "R001", an email address of User A is indicated as the account of User A. The reservation-making user account is an example of reservation-making user identification information for identifying a user who made a reservation. The event name indicates a name of a conference that is held using the resources such as a conference room. The resource ID is an example of resource identification information for identifying a resource such as a conference room. The start date and time is a scheduled start date and time when the event is scheduled to start. The end date and time is a scheduled end date and time when the event is scheduled to end. The expected participant account is one or more accounts of one or more users who is to participate in the event. In the description of the embodiment, an email address of a corresponding user is used as the expected participant account as is the case with the reservation-making user account. The expected participant account is an example of expected participant identification information for identifying an expected participant.

The event name, the resource ID, the start date and time, and the end date and time are included in reservation information.

Functional Units of Reservation Management Server:

The data transmission/reception unit 51 of the reservation management server 5, which is implemented by the processing of the CPU 501 with respect to the network I/F 509, transmits or receives various data (or information) to or from other devices via the communication network 100.

The storing/reading unit 59, which is mainly implemented by processing of the CPU 501, stores various data (or information) in the storage unit 5000 or reads various data (or information) from the storage unit 5000.

Functional Units of Intermediary Server:

As illustrated in FIG. 5, the intermediary server 6 includes a data transmission/reception unit 61, an authentication unit 62, a generation unit 63, and a storing/reading unit 69. These units are caused to function by operating one or more hardware components illustrated in FIG. 2 in cooperation with instructions of the CPU 601 according to the control program for the intermediary server loaded from the HD 604 to the RAM 603.

The intermediary server 6 further includes a storage unit 6000, which is implemented by the ROM 602 or the HD 604 illustrated in FIG. 2.

User Management Table:

FIG. 7A is a conceptual diagram illustrating a user management table according to the present embodiment. The user management table is a table for managing individual information of each user. The storage unit 6000 stores a user management DB 6001 including the user management table as illustrated in FIG. 7A. The user management table manages one or more records each including data items of organization ID, user account, and user name, which are associated with each other.

The organization ID is an example of organization identification information for identifying an organization (business operator, company) to which a corresponding user belongs. The user account is an example of user identification information for identifying a user. In the user management table illustrated in FIG. 7A, an email address of a corresponding user is used as an account of the user. When the user is the reservation-making user, the user account is managed as the reservation-making user account in the above-mentioned reservation information management table. When the user is one of the expected participants, the user account is managed as the expected participant account in the above-mentioned reservation information management table. The user name is a name of a corresponding user.

Event Management Table:

FIG. 7B is a conceptual diagram illustrating an event management table according to the present embodiment. The event management table is a table for managing detailed information of each event such as a meeting. The storage unit 6000 stores an event management DB 6002 including the event management table as illustrated in FIG. 7B. The reservation management table manages one or more records each including a data item of event status in addition to the data items of reservation ID, reservation-making user account, event name, resource ID, start date and time, end date and time, and expected participant account, which are associated with each other. The redundant description of the same information as the information managed in the reservation management table described above is omitted in the following. The event status is information that mainly indicates a status of an event such as a conference.

Key Type Management Table:

FIG. 7C is a conceptual diagram illustrating a key type management table according to an embodiment of the present disclosure. The key type management table is a table for managing a type of each key used for unlocking and locking a drive device such as a smart lock. The storage unit 6000 stores a key type management DB 6003 including the key type management table illustrated in FIG. 7C. The key type management table manages one or more records each including data items of organization ID, resource name, resource ID, key type, drive device ID, and access location information, which are associated with each other.

The organization ID and the resource ID are the same as the organization ID in the user information management table described above and the resource ID in the event management table described above, and thus the redundant description is omitted. The resource name is the name of a resource such as a conference room.

In addition, the key type indicates a type of method for unlocking and locking (unlocking method). In the key type management table illustrated in FIG. 7C, "ELECTRONIC KEY", "PHYSICAL KEY", and "NONE" are indicated as examples of key types. The key type of "ELECTRONIC KEY" indicates a method of unlocking or locking a drive device such as the smart lock 9 by using electronic information such as authentication information by remote control. The key type of "PHYSICAL KEY" indicates a method of unlocking or locking in a way that a user inserts a physical key such as a key made of metal into a keyhole to unlock or lock without using a drive device such as the smart lock 9. The key type of "NONE" indicates that a key is not required to open (unlock) or close (lock) the door.

The drive device ID is an example of drive device identification information for identifying a drive device such as the smart lock 9. The access location information indicates an access destination where information on the key is or indicates a location where the key actually is. The access location information indicates a location in relation to the key. The location and the access location information differ depending on the key type.

When the key type is indicated as "ELECTRONIC KEY", the access destination for the key indicates information on a location where the intermediary server 6 accesses via the communication network 100. In the key type management table in FIG. 7C, a URL of the drive control server 7 is indicated as the information on the location, which is the access destination.

When the key type is indicated as "PHYSICAL KEY", the access location information (destination) indicates a location where a user is to stop off at (physically access). In the key type management table in FIG. 7C, 1st floor security room where a corresponding physical key is stored and managed is indicated as information on the location (access location information).

When the key type is indicated as "NONE", there is no information on the location including the access destination, because the key is not required to open (unlock) or close (lock) the door.

Functional Units of Intermediary Server:

The data transmission/reception unit 61 of the intermediary server 6, which is implemented by the processing of the CPU 601 with respect to the network I/F 609, transmits or receives various data (or information) to or from other devices via the communication network 100.

The authentication unit 62 is mainly implemented by processing of the CPU 601 and authenticates whether the reservation-making user has an authority to reserve a resource such as a conference room.

The generation unit 63 is mainly implemented by processing of the CPU 601 and generates a predetermined message using the information read from each of the user management DB 6001, the event management DB 6002, and the key type management DB 6003.

The storing/reading unit 69, which is mainly implemented by processing of the CPU 601, stores various data (or information) in the storage unit 6000 or reads various data (or information) from the storage unit 6000.

Functional Configuration of Drive Control Server:

As illustrated in FIG. 5, the drive control server 7 includes a data transmission/reception unit 71, an issuing unit 72, a determination unit 75, and a storing/reading unit 79. These units are caused to function by operating one or more hardware components illustrated in FIG. 2 in cooperation with the instructions of the CPU 701 according to the control program for the drive control server loaded from the HD 704 to the RAM 703.

The drive control server 7 further includes a storage unit 7000, which is implemented by the ROM 702 or the HD 704 illustrated in FIG. 2.

Drive Device Management Table:

FIG. 8 is a conceptual diagram illustrating a drive device management table according to an embodiment of the present disclosure. The drive device management table is a table for managing information on a drive device such as the smart lock 9. The storage unit 7000 stores a drive device management DB 7001 including the drive device management table as illustrated in FIG. 8. The drive device management table manages one or more records each including data items of drive device ID, drive device destination information, authentication information, valid period of the authentication information, and status of the drive device, which are associated with each other.

The drive device ID is the same as the drive device ID managed in the above-mentioned key type management table. The drive device ID allows the intermediary server 6 and the drive control server 7 to perform processing in cooperation with each other.

The drive device destination information indicates a destination of a corresponding drive device such as the smart lock 9 on the communication network 100. The destination information is indicated by, for example, an internet protocol (IP) address or a media access control (MAC) address.

The authentication information is information required for an authentication when a drive device such as the smart lock 9 unlocks or locks. The authentication information is, for example, a passcode or a password.

The valid period of the authentication information indicates a period during which the drive control server 7 can effectively use the authentication information. As illustrated in FIG. 8, the same drive device (drive device ID "d001") has two or more records each includes different authentication information and the valid period of the corresponding authentication information. Accordingly, even the resource is the same conference room, the smart lock 9 is unlocked or locked only during the period reserved by the corresponding reservation-making user.

The status of the drive device indicates a status of unlocking or locking in relation to the drive device such as the smart lock 9.

Function Units of Drive Control Server:

The data transmission/reception unit 71 of the drive control server 7, which is implemented by the processing of the CPU 701 with respect to the network I/F 709, transmits or receives various data (or information) to or from other devices via the communication network 100.

The issuing unit 72 is mainly implemented by processing of the CPU 701 and issues the authentication information.

The determination unit 75 is mainly implemented by processing of the CPU 701 and makes various determinations. For example, the determination unit 75 determines validity of the authentication information.

The storing/reading unit 79, which is mainly implemented by processing of the CPU 701, stores various data (or information) in the storage unit 7000 or reads various data (or information) from the storage unit 7000.

Functional configuration of Smart Lock:

As illustrated in FIG. 5, the smart lock 9 includes a data transmission/reception unit 91 and a drive control unit 92. These units are caused to function by operating one or more hardware components illustrated in FIG. 4 in cooperation with instructions of the CPU 901 according to the control program for the smart lock loaded from the NVRAM 904 to the RAM 903.

Functional Units of Smart Lock:

The data transmission/reception unit 91 of the smart lock 9, which is implemented mainly by the processing of the CPU 901 with respect to the long-range communication circuit 909, transmits or receives various data (or information) to or from other devices via the communication network 100.

The drive control unit 92 is mainly implemented by processing of the CPU 901 and drives the unlocking/locking device 905 to unlock or lock.

Processes or Operation:

A description is given below of processes or operation according to the present embodiment, with reference to FIG. 9 to FIG. 24.

Figure 9:
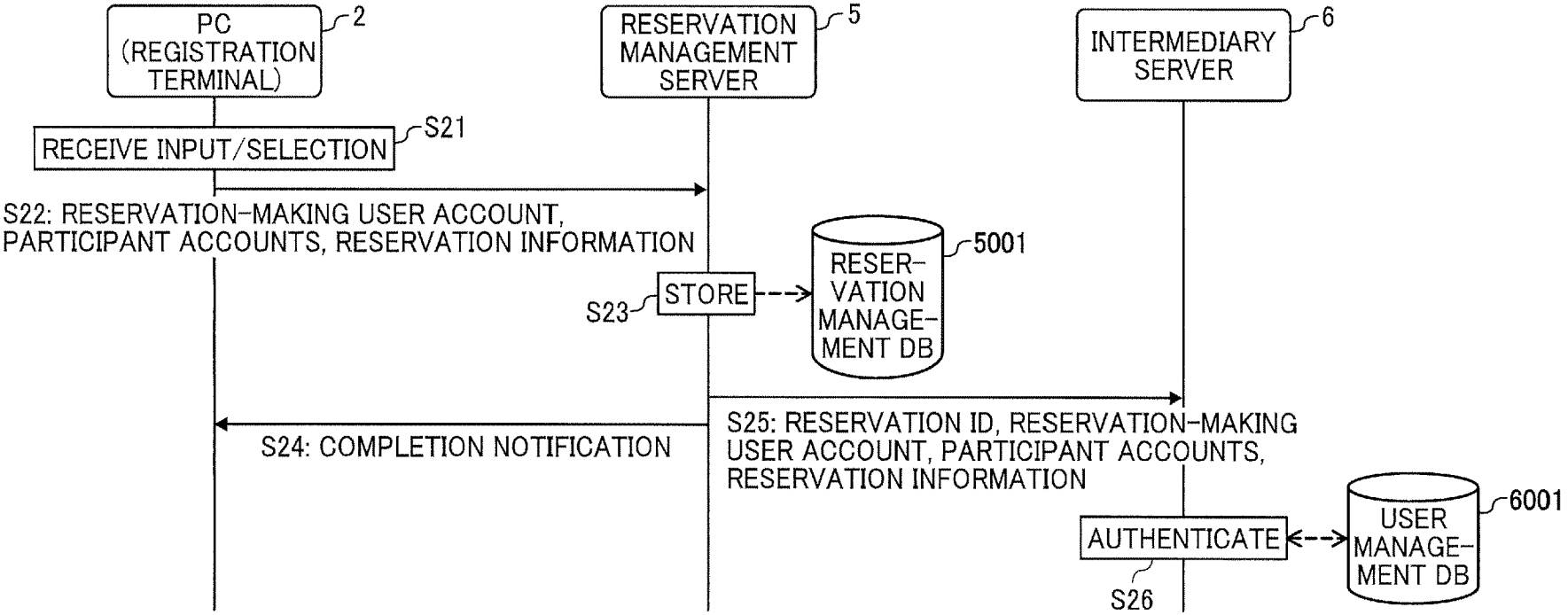
FIG. 9 is a sequence diagram illustrating a reservation registration process according to one or more embodiments of the disclosure.
Figure 10:
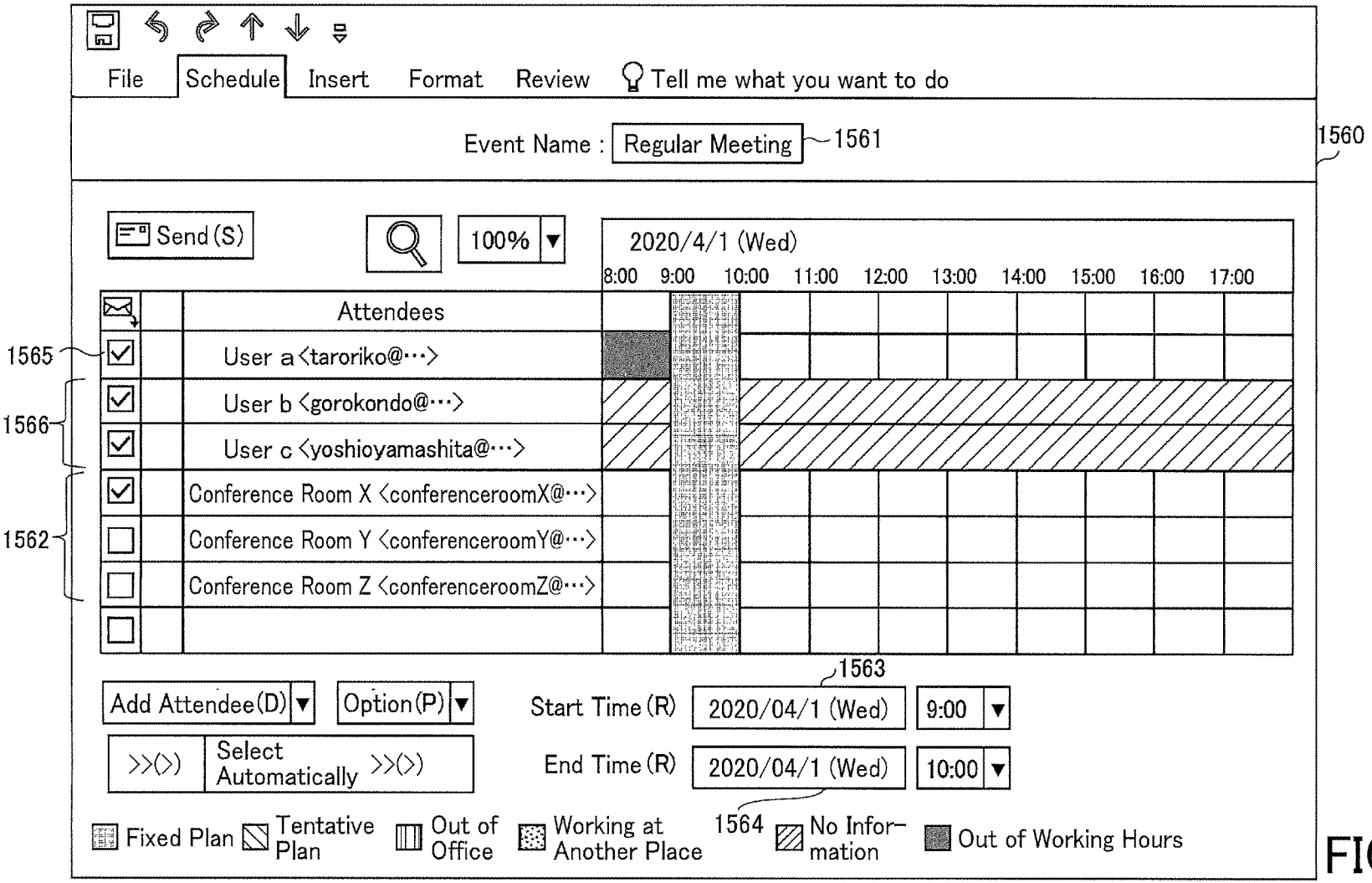
FIG. 10 is a diagram illustrating an example of a schedule input screen according to one or more embodiments of the disclosure.

Reservation Registration Process:

First, a case where User A reserves Conference Room A, which is an example of the resource, in the reservation management server 5 by using the PC 2 is described with reference to FIG. 9 to FIG. 12. FIG. 9 is a sequence diagram illustrating a reservation registration process according to an embodiment of the present disclosure. FIG. 10 is a diagram illustrating an example of a schedule input screen according to an embodiment of the present disclosure.

User A operates the PC 2 to input, with respect to a schedule input screen 1560 as illustrated in FIG. 10, the reservation information (event name, resource, event start time, event end time) and the expected participants. Accordingly, the reception unit 22 receives the user operations including the input or the selection in relation to the reservation information and the expected participants (S21). The schedule input screen 1560 includes an input field 1561 for inputting an event name, an input field 1562 for inputting a resource name, an input field 1563 for inputting a scheduled start date and time for the event, an input field 1564 for inputting a scheduled end date and time for the event, a display area 1565 for displaying a name of a reservation-making user (account of the reservation-making user), and a selection field 1566 for selecting the expected participants (accounts of the expected participants) other than the reservation-making user. In the present embodiment, the email addresses are used as the account of the reservation-making user and the accounts of the expected participants.

The data transmission/reception unit 21 of the PC 2 transmits, to the reservation management server 5, the information obtained by the user operation of inputting or selecting in step S21 (reservation-making user account, expected participant accounts, reservation information) (S22). Then, the data transmission/reception unit 51 of the reservation management server 5 receives the information. In addition, step S22 may be executed after the reservation-making user (User A) obtains approval to make the reservation from an approver such as a supervisor by sending, through the communication network 100, a request for the approval and receiving the approval via a PC used by the supervisor through the communication network 100.

The storing/reading unit 59 of the reservation management server 5 stores the information received in step S22 in the reservation management DB 5001 after assigning a reservation ID to the information to be managed in the reservation management DB 5001 (S23). After that, the data transmission/reception unit 51 transmits a completion notification indicating that making the reservation has been completed to the PC 2 (S24). Then, the data transmission/reception unit 21 of the PC 2 receives the completion notification.

The data transmission/reception unit 51 of the reservation management server 5 further transmits, to the intermediary server, the information (reservation ID, reservation-making user account, expected participant accounts, reservation information) stored in step S23 (S25). Then, the data transmission/reception unit 61 of the intermediary server 6 receives the information. Note that step S25 may be executed in a response to one of polling requests periodically transmitted from the intermediary server 6 to the reservation management server 5.

The intermediary server 6 performs user authentication based on a determination whether the reservation-making user account received in step S25 is managed by the user management DB 6001 as a user account (S26).

Figure 11:
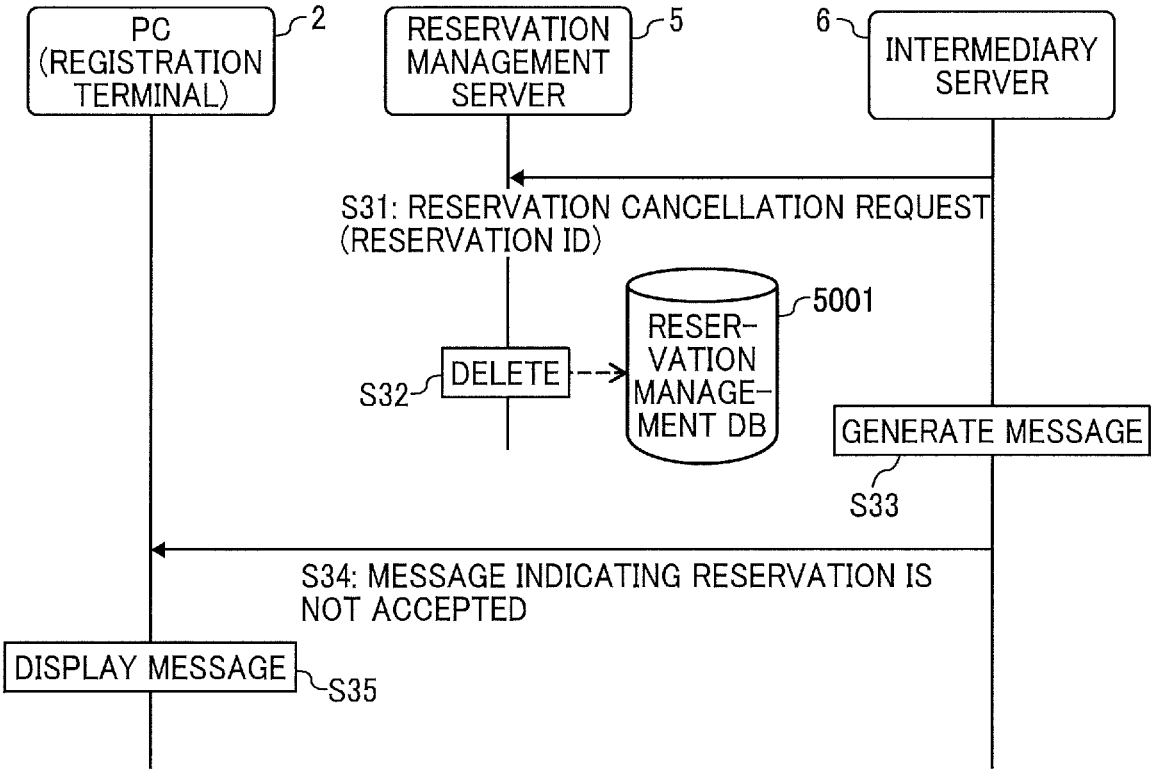
FIG. 11 is a sequence diagram illustrating a process performed in a case that a user is not authenticated as an authorized user, according to one or more embodiments of the disclosure.

In case that User is not Authenticated:

Next, a case where User A is not authenticated by the user authentication in step S26 is described with reference to FIG. 11. FIG. 11 is a sequence diagram illustrating a process performed in a case that the user is not authenticated as an authorized user, according to an embodiment of the present disclosure.

As illustrated in FIG. 11, the data transmission/reception unit 61 of the intermediary server 6 transmits a reservation cancellation request to the reservation management server 5 (S31). The reservation cancellation request includes the reservation ID received in step S25. Then, the data transmission/reception unit 51 of the reservation management server 5 receives the reservation cancellation request.

The storing/reading unit 59 of the reservation management server 5 deletes the reservation ID and the information, which is stored together with the reservation ID in step S23 (S32).

The generation unit 63 of the intermediary server 6 generates a message to be transmitted to the PC 2, the message indicates that the reservation is not accepted, namely, making the reservation is failed (S33). Then, the data transmission/reception unit 61 transmits, to the PC 2, the message, which is generated in step S33 and indicates that the reservation is failed to be made (S34). In the present embodiment, because the data transmission/reception unit 61 of the intermediary server 6 has received an email address as the reservation-making user account in step S25, the data transmission/reception unit 61 transmits the message, which indicates that the reservation is failed to be made, by specifying the an email address as a transmission destination. Then, the data transmission/reception unit 21 of the PC 2 receives the message indicating that the reservation is failed to be made. Then, the display control unit 24 of the PC 2 causes the display 208 to display the message indicating that the reservation is failed to be made (S35).

Figure 12:
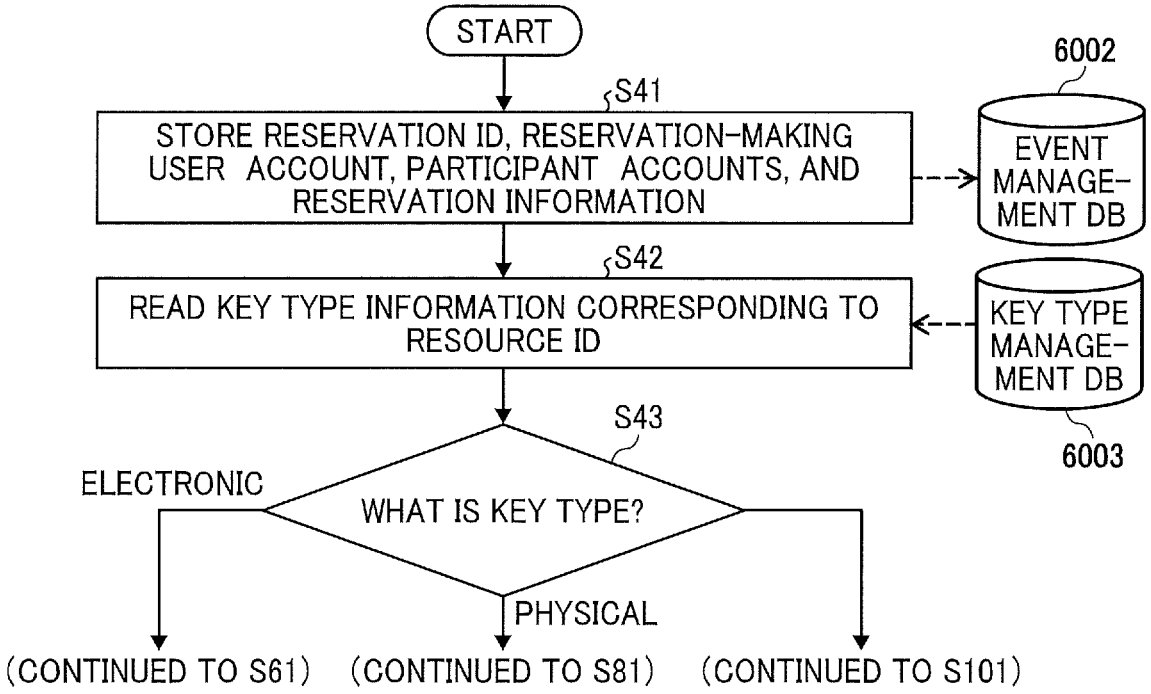
FIG. 12 is a flowchart illustrating a key type determination process performed by an intermediary server when a user is authenticated successfully, according to one or more embodiments of the disclosure.

In case that User is Authenticated:

Next, a case where User A is successfully authenticated by the user authentication in step S26 is described with reference to FIG. 12. FIG. 12 is a flowchart illustrating a key type determination process performed by the intermediary server 6 when the user is authenticated successfully.

First, the storing/reading unit 69 associates the information items, reservation ID, reservation-making user account, expected participants accounts, and reservation information received in step S25, and stores the associated information as a new record to be managed in the event management DB 6002 (S41). At this time, an "event status" in the new record is not managed.

Next, the storing/reading unit 69 reads corresponding key type information by searching the key type management DB 6003 using the resource ID in the reservation information stored in step S41 as a search key (S42). When the key type is indicated as "ELECTRONIC KEY", the processing after step S61, which is described in detail later, is executed. When the key type is indicated as "PHYSICAL KEY", the processing after step S81, which is be described in detail later, is executed. Further, when the key type is indicated as "NONE", that is, when there is no key, the processing after step S101 is executed. Each process corresponding to the key type is described below.

Figure 13:
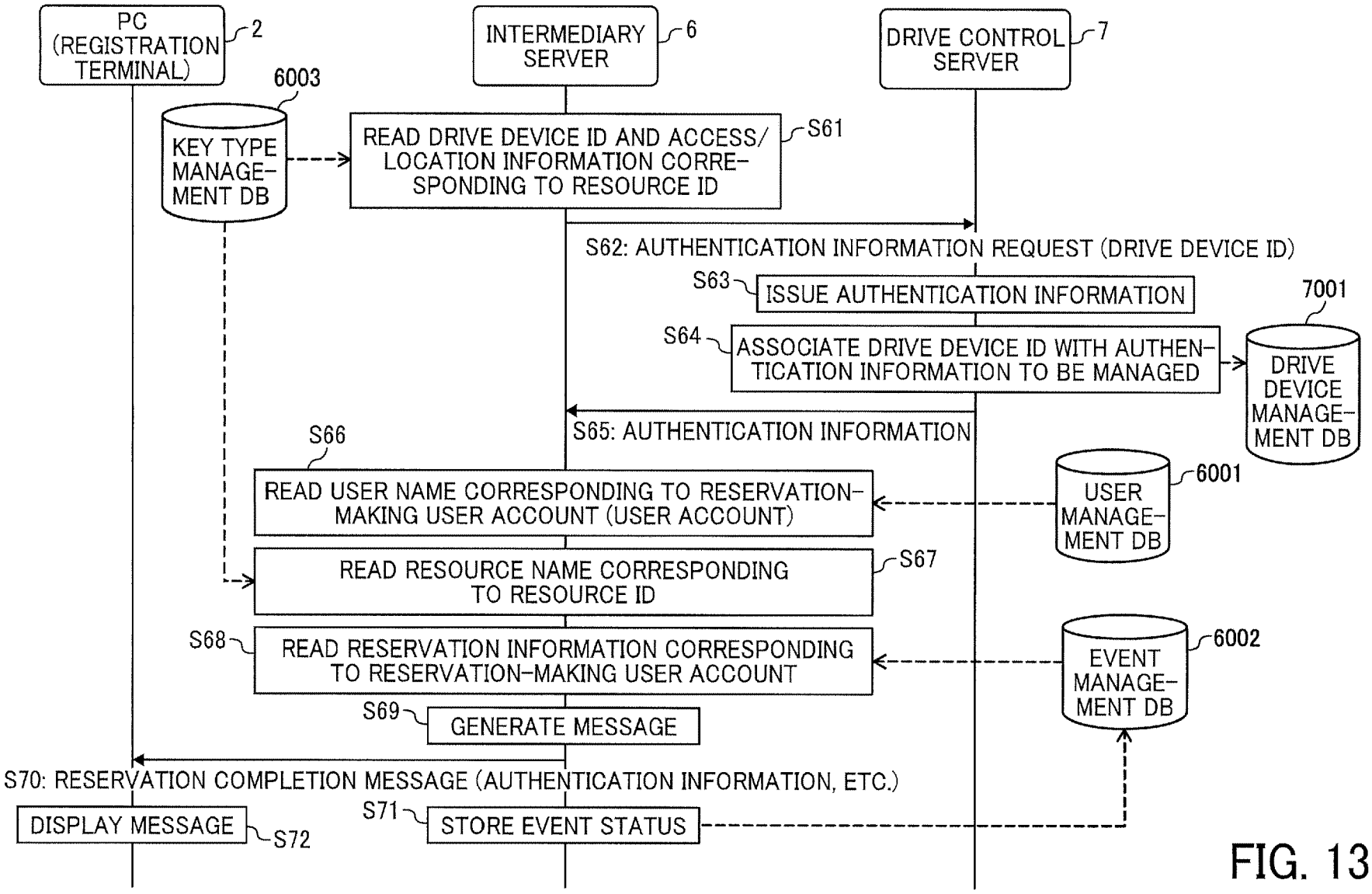
FIG. 13 is a sequence diagram illustrating a process of transmitting a message when a key type is indicated as "ELECTRONIC KEY", according to one or more embodiments of the disclosure.

In Case of Electronic Key:

First, a case where the key type is indicated as "ELECTRONIC KEY" is described with reference to FIG. 13 and FIG. 14. FIG. 13 is a sequence diagram illustrating a process of transmitting a message when the key type is indicated as "ELECTRONIC KEY", according to an embodiment of the present disclosure. FIG. 14 is an illustration of an example screen displayed on a PC when the key type is indicated as "ELECTRONIC KEY, according to an embodiment of the present disclosure.

As illustrated in FIG. 13, the storing/reading unit 69 of the intermediary server 6 searches the key type management DB 6003 using the resource ID in the reservation information received in step S25 as a search key to read a corresponding drive device ID and access location information (S61). Then, the data transmission/reception unit 61 transmits a request for authentication information to the access location of the drive control server 7 (S62). The request includes the drive device ID read in step S61. Then, the data transmission/reception unit 71 of the drive control server 7 receives the request for authentication information.

Next, the issuing unit 72 of the drive control server 7 issues unique authentication information (S63). Then, the storing/reading unit 79 stores the authentication information issued in step S63 as a data item of the record in which the same drive device ID received in step S62 is managed, and the record including the authentication information is managed in the drive device management DB 7001. (S64).

Next, the data transmission/reception unit 71 transmits the authentication information issued in step S63 to the intermediary server 6 (S65). Then, the data transmission/reception unit 61 of the intermediary server 6 receives the authentication information.

Next, the storing/reading unit 69 of the intermediary server 6 searches the user management DB 6001 using the reservation-making user (User A) account received in step S25 as a search key to read the corresponding user name (S66).

Next, the storing/reading unit 69 searches the key type management DB 6003 using the resource ID in the reservation information received in step S41 as a search key to read the corresponding resource name (S67).

Next, the storing/reading unit 69 searches the event management DB 6002 using the reservation-making user account received in step S41 as a search key to read the corresponding reservation information (S68). Then, the generation unit 63 uses the authentication information received in step S65 and the information read in steps S66 to S68 (reservation name (user name of the reservation-making user), resource name, reserved information) to generate a message that is a reservation completion message indicating that making the reservation is completed and to be transmitted together with the authentication information, as illustrated in FIG. 14 (S69).

Next, the data transmission/reception unit 61 of the intermediary server 6 transmits to the PC 2 the reservation completion message, which is generated in step S69 and indicates that making the reservation is completed together with the authentication information (S70). Then, the data transmission/reception unit 21 of the PC 2 receives the message.

The authentication information may always be the same information content. In this case, the drive control server 7 does not execute the processing of step S63 but adjusts a time to transmit the authentication information in step S70. For example, the intermediary server 6 transmits the authentication information 10 minutes before the conference starts. Further, in step S70, the intermediary server 6 may transmit a reservation completion message not only to the PC 2 used by the reservation-making user (User A) but also to all or some of the PCs each of which is used by a corresponding participant who is scheduled to participate in the same conference.

Next, the storing/reading unit 69 manages the "event status" in the record including the reservation-making user account read in step S68 as "authentication information has been informed" in the event management DB 6002 (S71). As a result, the "event status", which is not managed in step S41, is managed with new information.

Next, the display control unit 24 of the PC 2 causes the display 208 to display a message screen as illustrated in FIG. 14. This allows the reservation-making user (User A) who inputs or selects the reservation information in step S21 to obtain, in step S72, information indicating that making the reservation is completed in addition to the authentication information required to unlock the resource.

Figure 15:
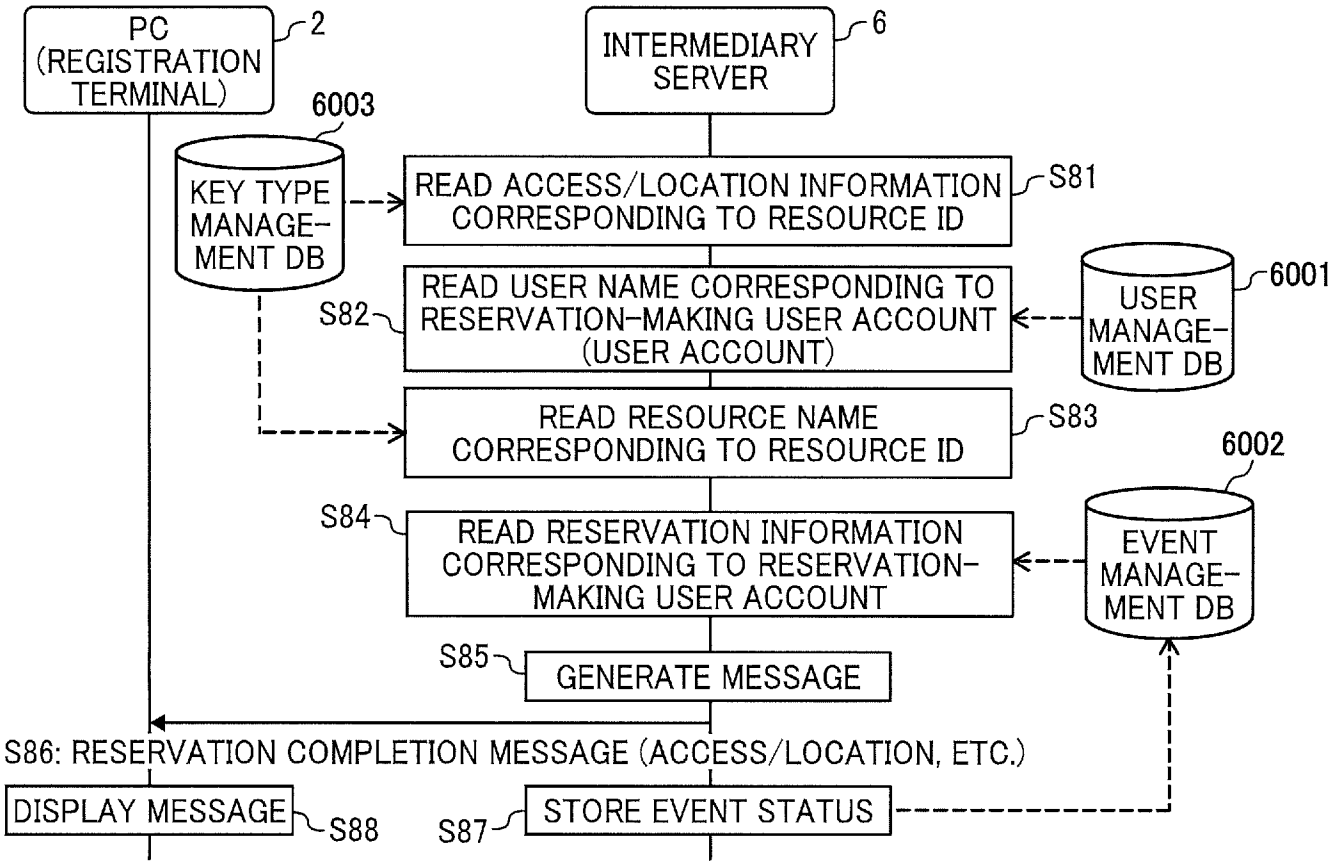
FIG. 15 is a sequence diagram illustrating a process of transmitting a message when a key type is indicated as "PHYSICAL KEY", according to one or more embodiments of the disclosure.

In Case of Physical Key:

Next, a case where the key type is indicated as "PHYSICAL KEY" is described with reference to FIG. 15 and FIG. 16. FIG. 15 is a sequence diagram illustrating a process of transmitting a message when the key type is indicated as "PHYSICAL KEY", according to an embodiment of the present disclosure. FIG. 16 is an illustration of an example screen displayed on a PC when the key type is indicated as "PHYSICAL KEY", according to an embodiment of the present disclosure.

As illustrated in FIG. 15, the storing/reading unit 69 of the intermediary server 6 searches the key type management DB 6003 using the resource ID in the reservation information received in step S25 as a search key to read a corresponding drive device ID and access location information (S81). Unlike the case of "ELECTRONIC KEY" described above, there is no processing (steps S62 to S65) for acquiring the authentication information from the drive control server 7. The storing/reading unit 69 of the intermediary server 6 searches the user management DB 6001 using the reservation-making user (User A) account received in step S25 as a search key to read the corresponding user name (S82).

Next, the storing/reading unit 69 searches the key type management DB 6003 using the resource ID in the reservation information received in step S41 as a search key to read the corresponding resource name (S83).

Next, the storing/reading unit 69 searches the event management DB 6002 using the reservation-making user account received in step S41 as a search key to read the corresponding reservation information (S84). Then, the generation unit 63 uses the information (access location information, reservation name (user name of the reservation-making user), resource name, reservation information) read in steps S81 to S84 to generate a message that is a reservation completion message indicating that making the reservation is completed and to be transmitted together with the access location information, as illustrated in FIG. 16 (S85). Since the key type is indicated as "PHYSICAL KEY", a location where a corresponding physical key is stored, managed, or kept, (for example, security room on 1st floor) is indicated as the access location information, as illustrated in FIG. 16.

Next, the data transmission/reception unit 61 of the intermediary server 6 transmits to the PC 2 the message, which is generated in step S85 and indicates that making the reservation is completed together with the access location information (S86). Then, the data transmission/reception unit 21 of the PC 2 receives the message. Then, the storing/reading unit 69 manages the "event status" in the record including the reservation-making user account read in step S84 as "access location information has been informed" in the event management DB 6002 (S87). As a result, the "event status", which is not managed in step S41, is managed with new information.

Next, the display control unit 24 of the PC 2 causes the display 208 to display a message screen as illustrated in FIG. 16 (S88). This allows the reservation-making user (User A) who inputs or selects the reservation information in step S21 to obtain, in step S88, information indicating that making the reservation is completed in addition to the access location information required to unlock the resource.

Figure 17:
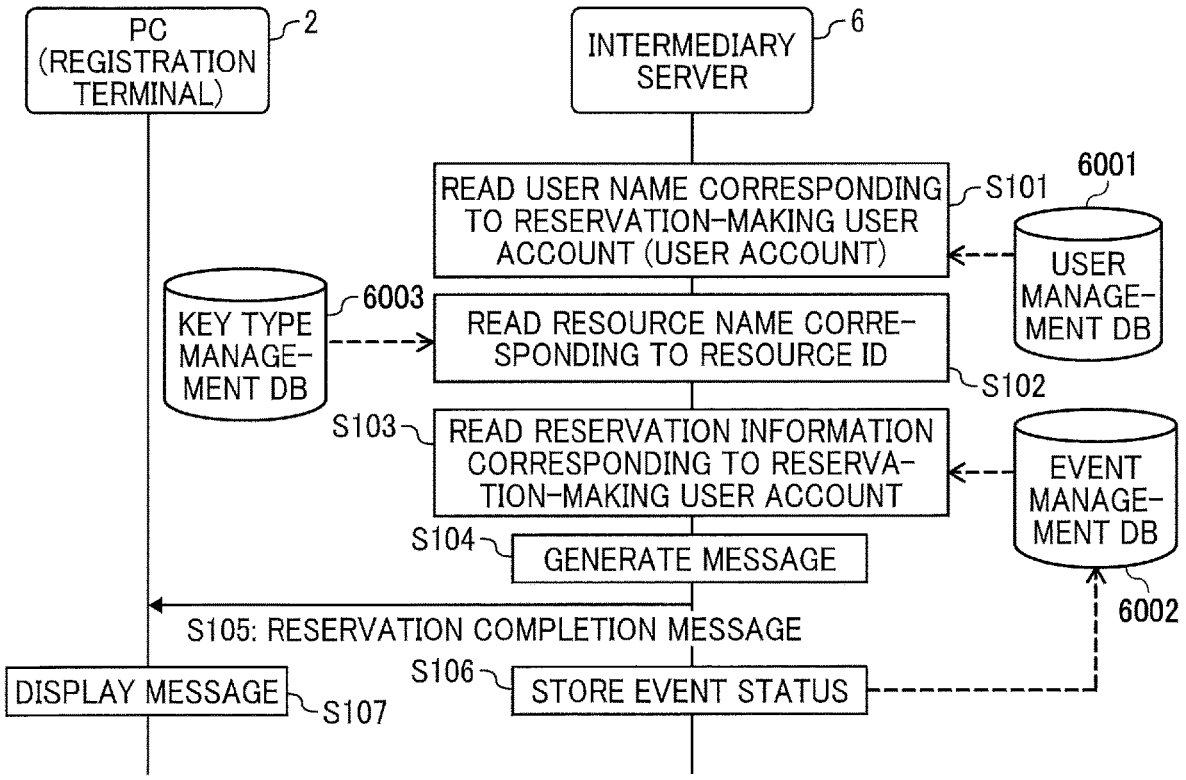
FIG. 17 is a sequence diagram illustrating a process of transmitting a message when a key type is indicated as "NONE", according to one or more embodiments of the disclosure.

In Case that Kye is Not Used:

Subsequently, a case where the key type is indicated as "NONE" is described with reference to FIG. 17 and FIG. 18. FIG. 17 is a sequence diagram illustrating a process of transmitting a message when the key type is indicated as "NONE", according to an embodiment of the present disclosure. FIG. 18 is an illustration of an example screen displayed on a PC when the key type is indicated as "NONE", according to an embodiment of the present disclosure. The key type, "NONE", means there is no key to be used. Accordingly, the storing/reading unit 69 is not required to read the access location information as in step S61 (S81).

As illustrated in FIG. 17, the storing/reading unit 69 of the intermediary server 6 searches the user management DB 6001 using the reservation-making user (User A) account received in step S25 as a search key to read the corresponding user name (S101).

Next, the storing/reading unit 69 searches the key type management DB 6003 using the resource ID in the reservation information received in step S41 as a search key to read the corresponding resource name (S102).

Next, the storing/reading unit 69 searches the event management DB 6002 using the reservation-making user account received in step S41 as a search key to read the corresponding reservation information (S103). Then, the generation unit 63 uses the information (reservation name (user name of the reservation-making user), resource name, reservation information) read in steps S101 to S103 to generate a message indicating that making the reservation is completed as illustrated in FIG. 18 (S104).

Next, the data transmission/reception unit 61 of the intermediary server 6 transmits to the PC 2 the message, which is generated in step S85 and indicates that making the reservation is completed (S105). Then, the data transmission/reception unit 21 of the PC 2 receives a message for notifying the completion of the reservation. Then, the storing/reading unit 69 manages the "event status" in the record including the reservation-making user account read in step S103 as "reservation completion has been informed" in the event management DB 6002 (S106). As a result, the "event status", which is not managed in step S41, is managed with new information.

Next, the display control unit 24 of the PC 2 causes the display 208 to display a message screen as illustrated in FIG. 16. This allows the reservation-making user (User A) who inputs or selects the reservation information in step S21 to obtain, in step S107, information indicating that making the reservation is completed.

Figure 19:
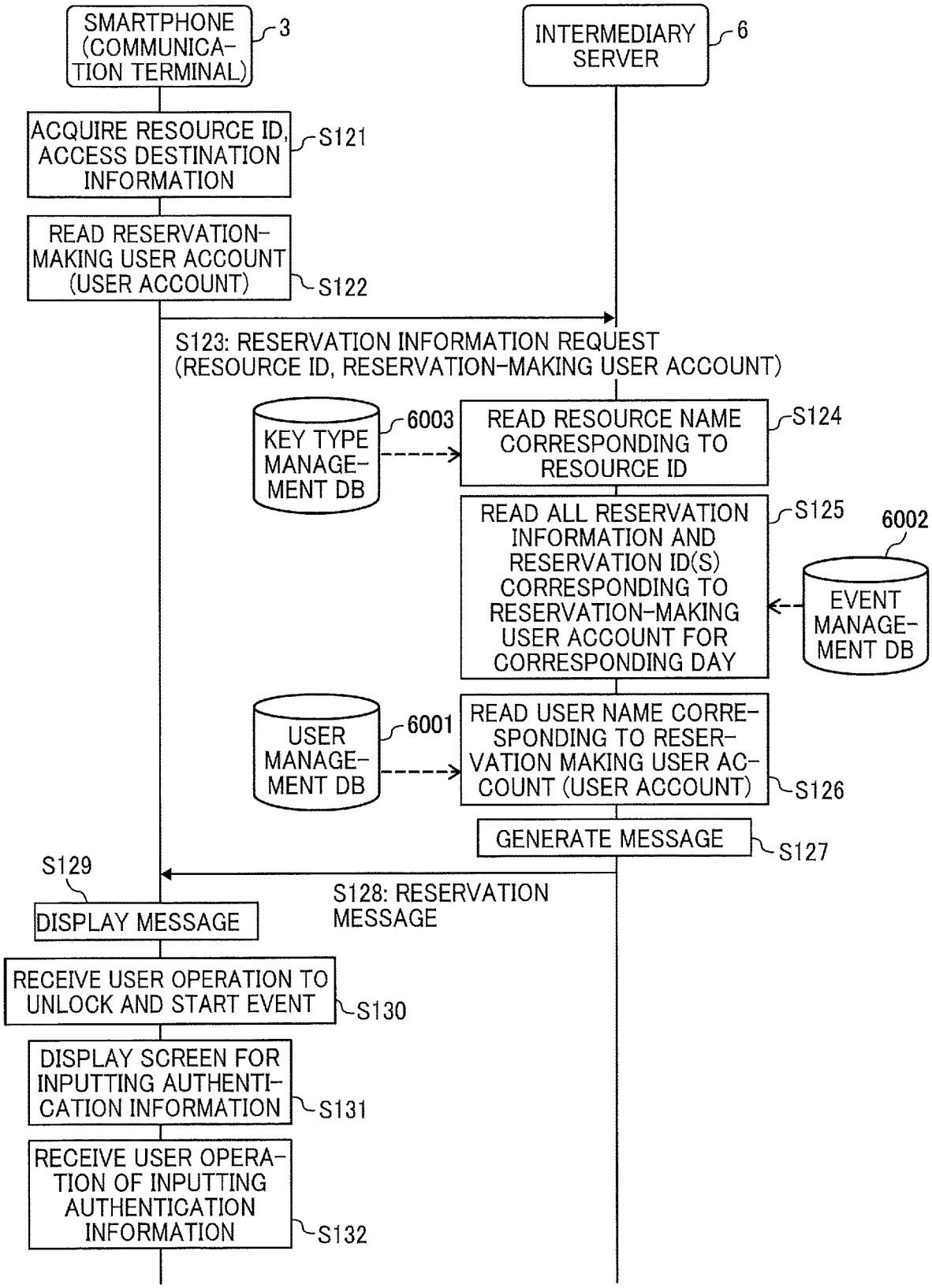
FIG. 19 is a sequence diagram illustrating a remote unlocking process when a key type is indicated as "ELECTRONIC KEY", according to one or more embodiments of the disclosure.
Figure 20:
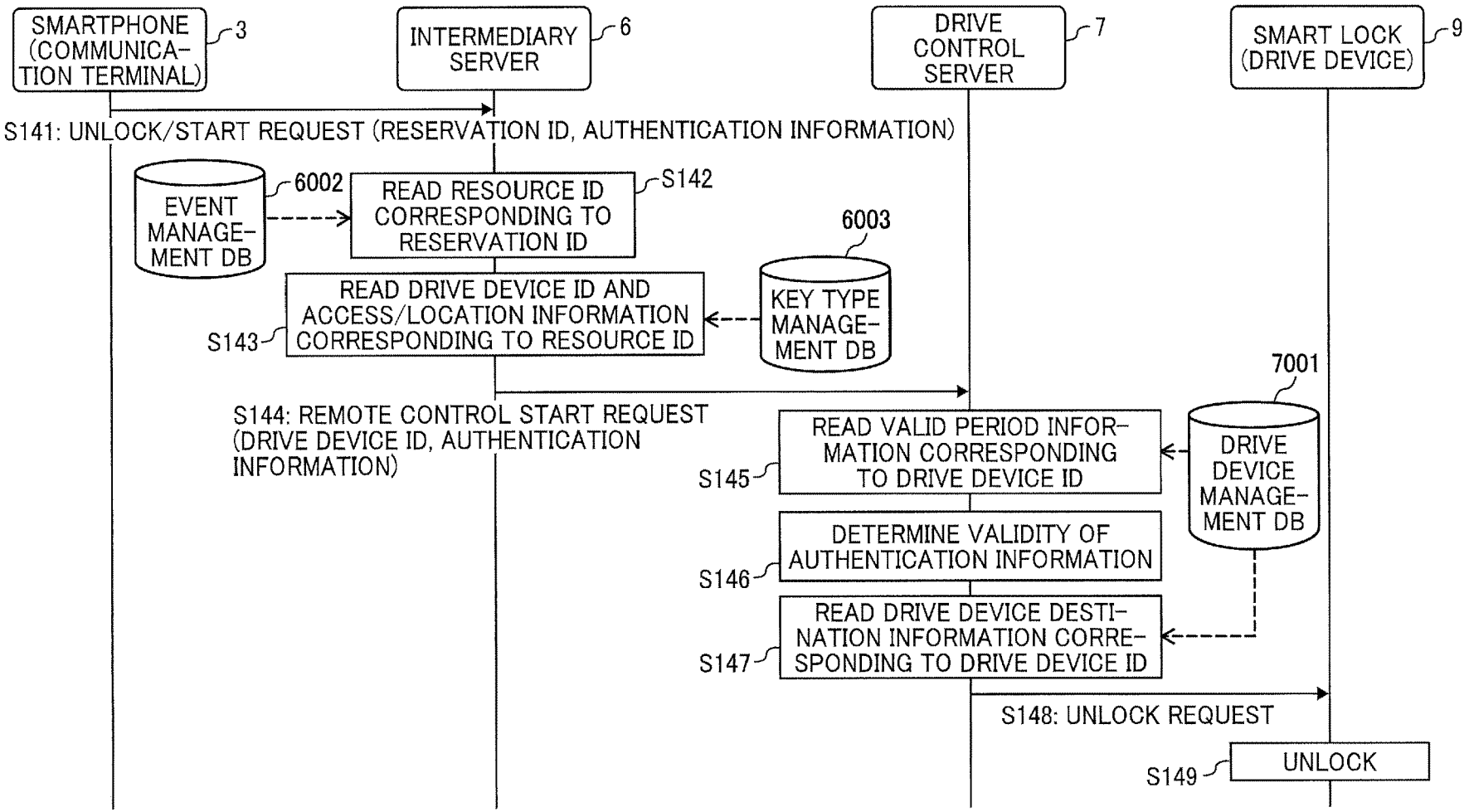
FIG. 20 is another sequence diagram illustrating a remote unlocking process when a key type is indicated as "ELECTRONIC KEY", according to one or more embodiments of the disclosure.
Figure 21:
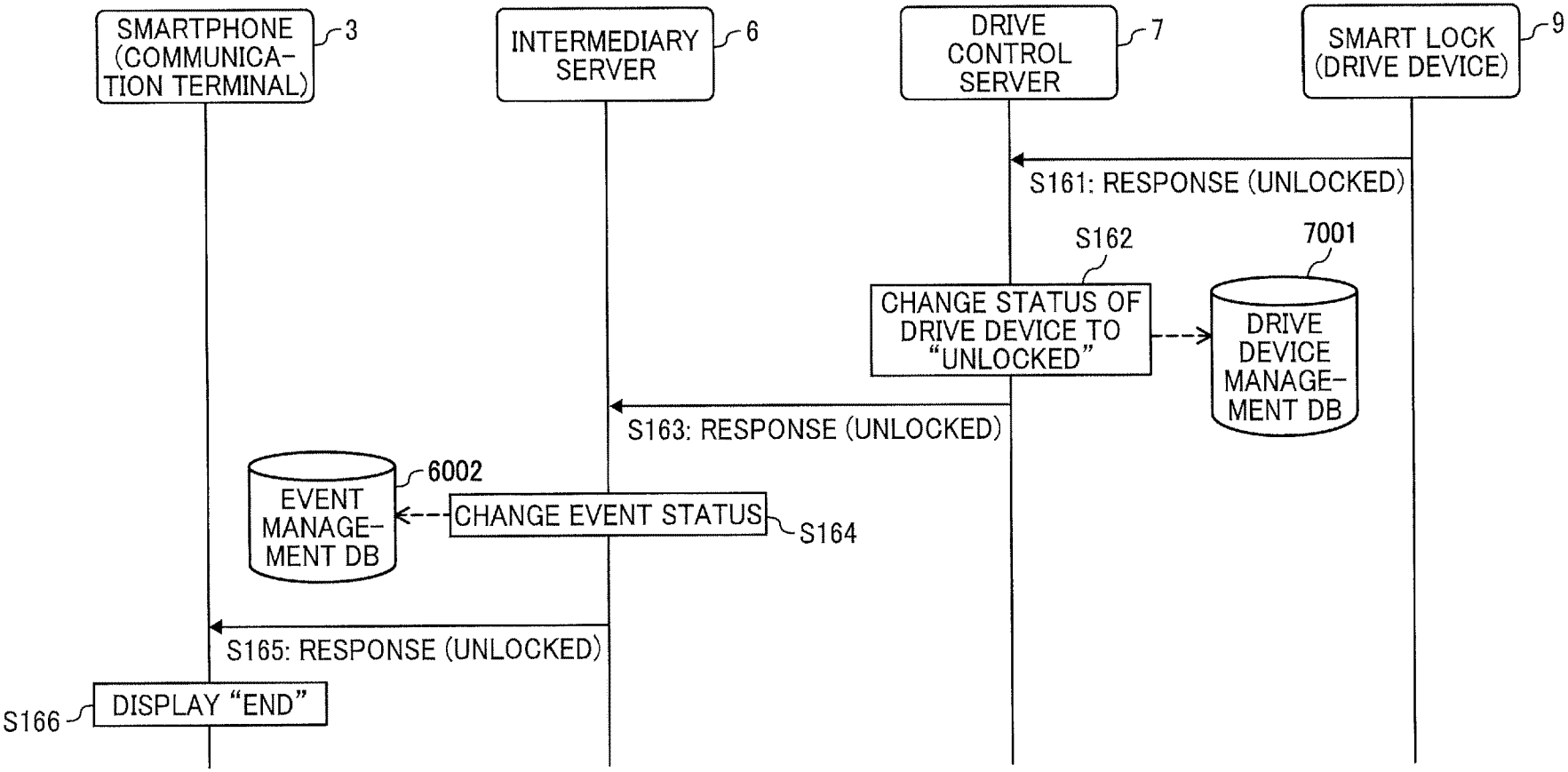
FIG. 21 is still another sequence diagram illustrating a remote unlocking process when a key type is indicated as "ELECTRONIC KEY", according to one or more embodiments of the disclosure.

Remote Unlocking Process Using Electronic Key:

A description is given below of a remote unlocking process using a key of which the key type is indicated as "ELECTRONIC KEY" with respect to the smart lock 9 with reference to FIG. 19 to FIG. 22 (FIG. 22A to FIG. 22D). FIG. 19 to FIG. 21 are sequence diagrams illustrating a remote unlocking process when the key type is indicated as "ELECTRONIC KEY", according to an embodiment of the present disclosure. FIG. 22A to FIG. 22D are illustrations of example screens displayed on a smartphone when a conference starts, according to an embodiment of the present disclosure. In the description of the embodiment, User A who is in the front of the door 8 and the outside of Conference Room A unlocks the smart lock using his or her smartphone 3.

First, the acquisition unit 33 of the smartphone 3 obtains a resource ID and access destination information such as a URL, which are embedded in QR CODE indicated with the door 8 as illustrated in FIG. 1, by capturing an image of QR CODE according to a user operation performed by User A (S121). Further, the storing/reading unit 39 reads the reservation-making user account as User A stored in the storage unit 3000 (S122). Then, the data transmission/reception unit 31 of the smartphone 3 transmits a request for reservation information to the intermediary server 6 indicated by the access destination information (S123). The request for the reservation information includes the resource ID acquired in step S121 and the reservation-making user (User A) account read in step S122. Then, the data transmission/reception unit 61 of the intermediary server 6 receives the request for reservation information (S123).

Next, the storing/reading unit 69 of the intermediary server 6 searches the key type management DB 6003 using the resource ID in the reservation information received in step S123 as a search key to read the corresponding resource name (S124).

Next, the storing/reading unit 69 of the intermediary server 6 searches the event management DB 6002 using the reservation-making user account received in step S123 as a search key to read all reservation IDs and reservation information corresponding to all the reservation IDs on the event execution date (S125).

Next, the storing/reading unit 69 of the intermediary server 6 searches the user management DB 6001 using the reservation-making user (User A) account received in step S123 as a search key to read the corresponding user name (S126). Then, the generation unit 63 uses the information (resource name, reservation information for all the reservations on the execution date, reservation name (user name of the reservation-making user)) read in steps S124 to S126 to generate a reservation content message indicating details of the reservation and prompting the reservation-making user for performing a process to start the event, as illustrated in FIG. 22A (S127).

Next, the data transmission/reception unit 61 of the intermediary server 6 transmits the reservation content message generated in step S127 to the smartphone 3 (S128). The reservation content message includes the reservation ID. Then, the data transmission/reception unit 31 of the smartphone 3 receives the message.

Figure 22A:
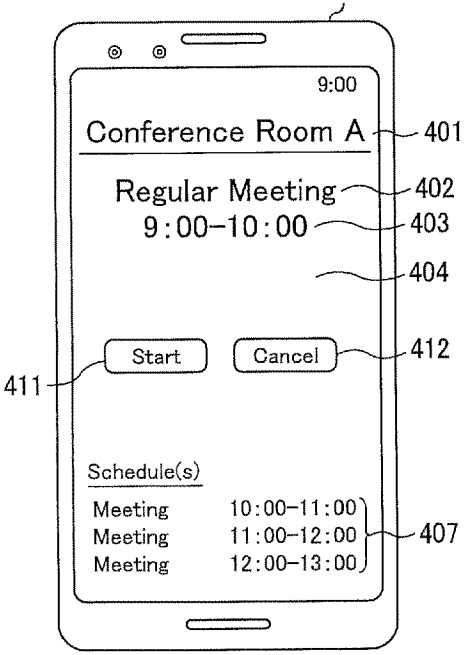
FIG. 22A to FIG. 22D are illustrations of example screens displayed on a smartphone when a conference starts, according to one or more embodiments of the disclosure.

Next, the display control unit 34 of the smartphone 3 causes the display 318 to display a message screen as illustrated in FIG. 22A (S129). The message screen includes a display field 401 for displaying a resource name (Conference Room A), a display field 402 for displaying an event name (Regular Meeting), a display field 403 for displaying a start date and time and end date and time, a display field 404 for displaying a name of a reservation-making user (User A), and a display field 407 for displaying a start date and time and an end date and time for each of the other events on the same day. The message screen further includes, a "Start" button 411 and a "Cancel" button 412. The "Start" button 411 is a button to be pressed by, for example, a reservation-making user when the smart lock 9 is remotely controlled and unlocked and an event is started. The "Cancel" button 412 is a button to be pressed by, for example, a reservation-making user when the smart lock 9 is remotely controlled and unlocked and an event is canceled without starting. As the "Start" button, an "Unlock" button may be used.

Figure 22B:
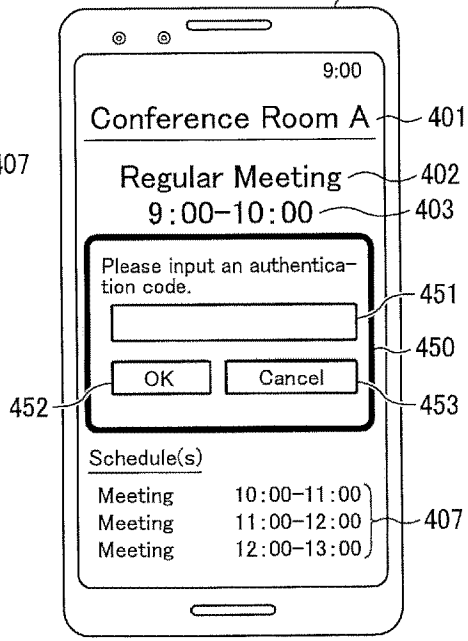

When the reservation-making user (User A) presses the "Start" button 411, the reception unit 32 receives the user operation for remotely controlling the smart lock 9 to be unlocked and starting the event (S130). As a result, the display control unit 34 pops up an authentication information input screen 450 for inputting the authentication information as illustrated in FIG. 22B (S131). As illustrated in FIG. 22B, the authentication information input screen 450 includes an authentication information input field 451 for inputting authentication information (authentication code), an "OK" button 452, and a "Cancel" button 453. The "OK" button 452 is a button to be pressed when the reservation-making user (User A) confirms the authentication information (code) entered in the authentication information input field 451. The "Cancel" button 453 is a button to be pressed when the reservation-making user (User A) confirms the authentication information (code) entered in the authentication information input field 451.

When the reservation-making user (User A) inputs the authentication information obtained in step S72 in the authentication information input field 451 and presses the "OK" button 452, the reception unit 32 receives the input of the authentication information (S132).

Subsequently, after the processing of step S132, the data transmission/reception unit 31 transmits an unlock request for the smart lock 9 and an event start request to the intermediary server 6, as illustrated in FIG. 20 (S141). The unlock request and the start request include the reservation ID received in step S128 and the authentication information received in step S132. Then, the data transmission/reception unit 61 of the intermediary server 6 receives the unlock request and the start request.

Next, the storing/reading unit 69 of the intermediary server 6 searches the event management DB 6002 using the reservation ID received in step S141 as a search key to read the corresponding resource ID (S142).

Next, the storing/reading unit 69 searches the key type management DB 6003 using the resource ID read in step S142 as a search key to read the corresponding drive device ID and access location information (S143). Then, the data transmission/reception unit 61 transmits a remote control start request for the smart lock 9 to the drive control server 7 indicated by the access location information (S144). This request includes the drive device ID read in step S143 and the authentication information received in step S141. Then, the data transmission/reception unit 71 of the drive control server 7 receives the remote control start request.

Next, the storing/reading unit 79 of the drive control server 7 searches the drive device management DB 7001 using the drive device ID received in step S144 as a search key to read information on a valid period of the corresponding authentication information (S145).

Next, the determination unit 75 determines the validity of the authentication information received in step S144. More specifically, the determination unit 75 determines whether a current date and time is within the valid period of the authentication information read in step S145 (S146). In the following, a case where the determination unit 75 determines that the authentication information is valid because the current date and time is within the valid period is described.

Next, the storing/reading unit 79 searches the drive device management DB 7001 using the driving device ID received in step S144 as a search key to read the corresponding drive device destination information (for example, IP address) (S147). Then, the data transmission/reception unit 71 transmits an unlock request to the smart lock 9 indicated by the drive device destination information read in step S147 (S148). Then, the data transmission/reception unit 91 of the smart lock 9 receives the unlock request.

Next, the drive control unit 92 of the smart lock 9 drives the unlocking/locking device 905 to unlock (S149). As a result, the smartphone 3 remotely unlocks the smart lock 9 via the intermediary server 6 and the drive control server 7.

Subsequently, as illustrated in FIG. 21, the data transmission/reception unit 91 of the smart lock 9 transmits a response indicating that unlocking is completed to the drive control server 7 (S161). Then, the data transmission/reception unit 71 of the drive control server 7 receives the response.

Next, the storing/reading unit 79 of the drive control server 7 changes "status of drive device" in the record including the drive device ID received in step S144 from "locked" to "unlocked". (S162). Then, the data transmission/reception unit 71 of the drive control server 7 transmits a response indicating that unlocking is completed to the intermediary server 6 (S163). Then, the data transmission/reception unit 81 of the intermediary server 6 receives the response.

Next, the storing/reading unit 69 of the intermediary server 6 changes "event status" in the record including the reservation ID received in step S141 from "authentication information has been informed" to "event has started". (S164). Then, the data transmission/reception unit 61 of the intermediary server 6 transmits a response indicating that unlocking is completed to the smartphone 3 (S165). Then, the data transmission/reception unit 31 of the smartphone 3 receives the response.

Figure 22C:
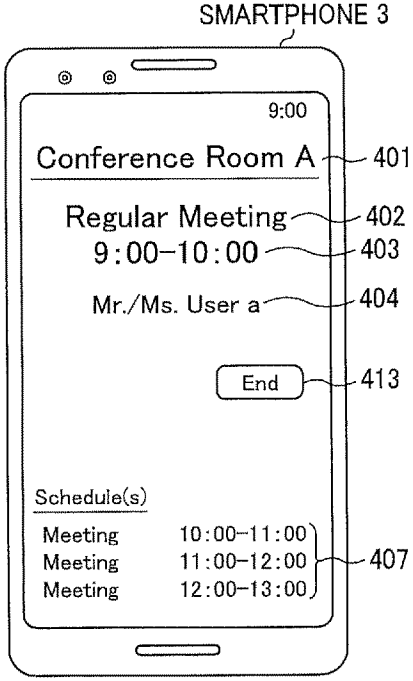

Next, the display control unit 34 of the smartphone 3 displays an "End" button 413 as illustrated in FIG. 22C (S166). This "End" button 413 is a button to be pressed by a reservation-making user (User A) or the like when the event is ended. In addition to sound indicating unlocking of the smart lock 9, the "End" button 413 being displayed allows the reservation-making user (User A) to know unlocking is completed.

Figure 22D:
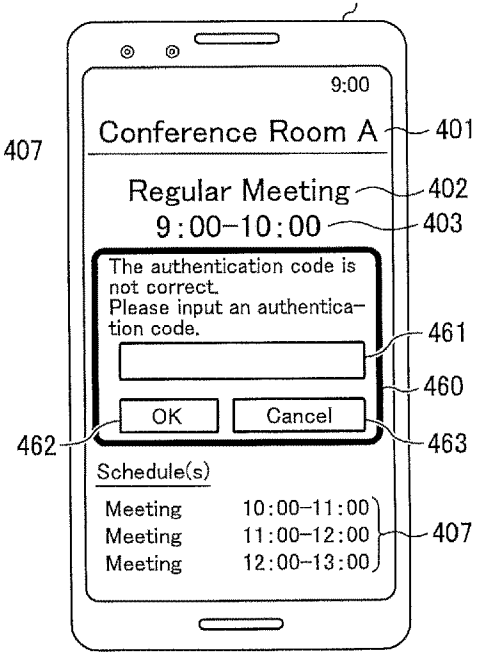

In a case that the reservation-making user (User A) mistakenly inputs the authentication information on the screen illustrated in FIG. 22B, the display control unit 34 displays an authentication information input screen 460 as a pop-up screen again as illustrated in FIG. 22D. As illustrated in FIG. 22D, the authentication information input screen 460 includes an authentication information input field 461 for inputting authentication information (authentication code), an "OK" button 462, and a "Cancel" button 463. The "OK" button 462 is a button to be pressed when the reservation-making user (User A) confirms the authentication information (code) entered in the authentication information input field 461. The "Cancel" button 463 is a button to be pressed when the reservation-making user (User A) confirms the authentication information (code) entered in the authentication information input field 461. When the reservation-making user (User A) inputs the authentication information obtained in step S72 in the authentication information input field 461 and presses the "OK" button 462, the reception unit 32 receives the input of the authentication information (S132).

Figure 23:
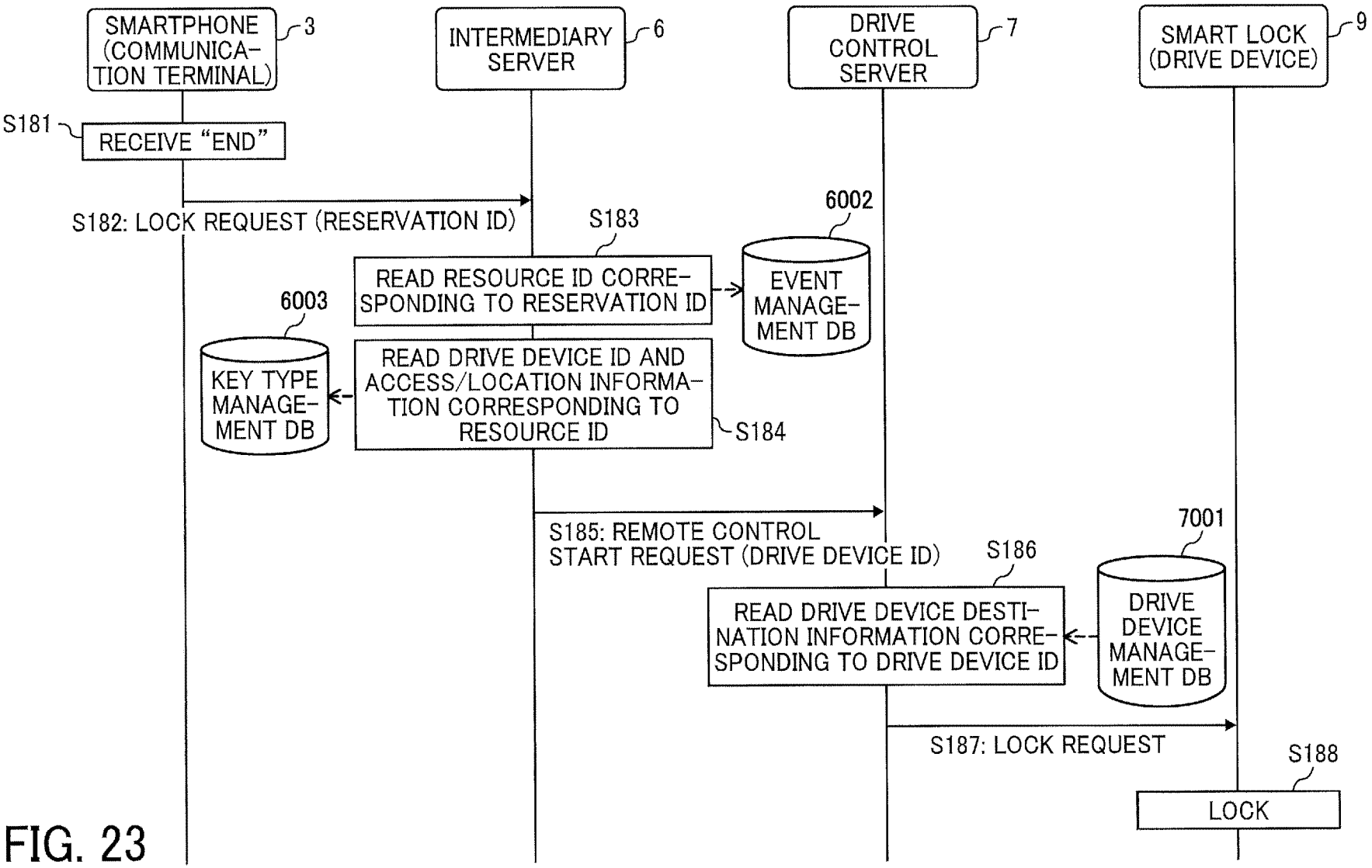
FIG. 23 is a sequence diagram illustrating a remote locking process when a key type is indicated as "ELECTRONIC KEY", according to one or more embodiments of the disclosure.
Figure 24:
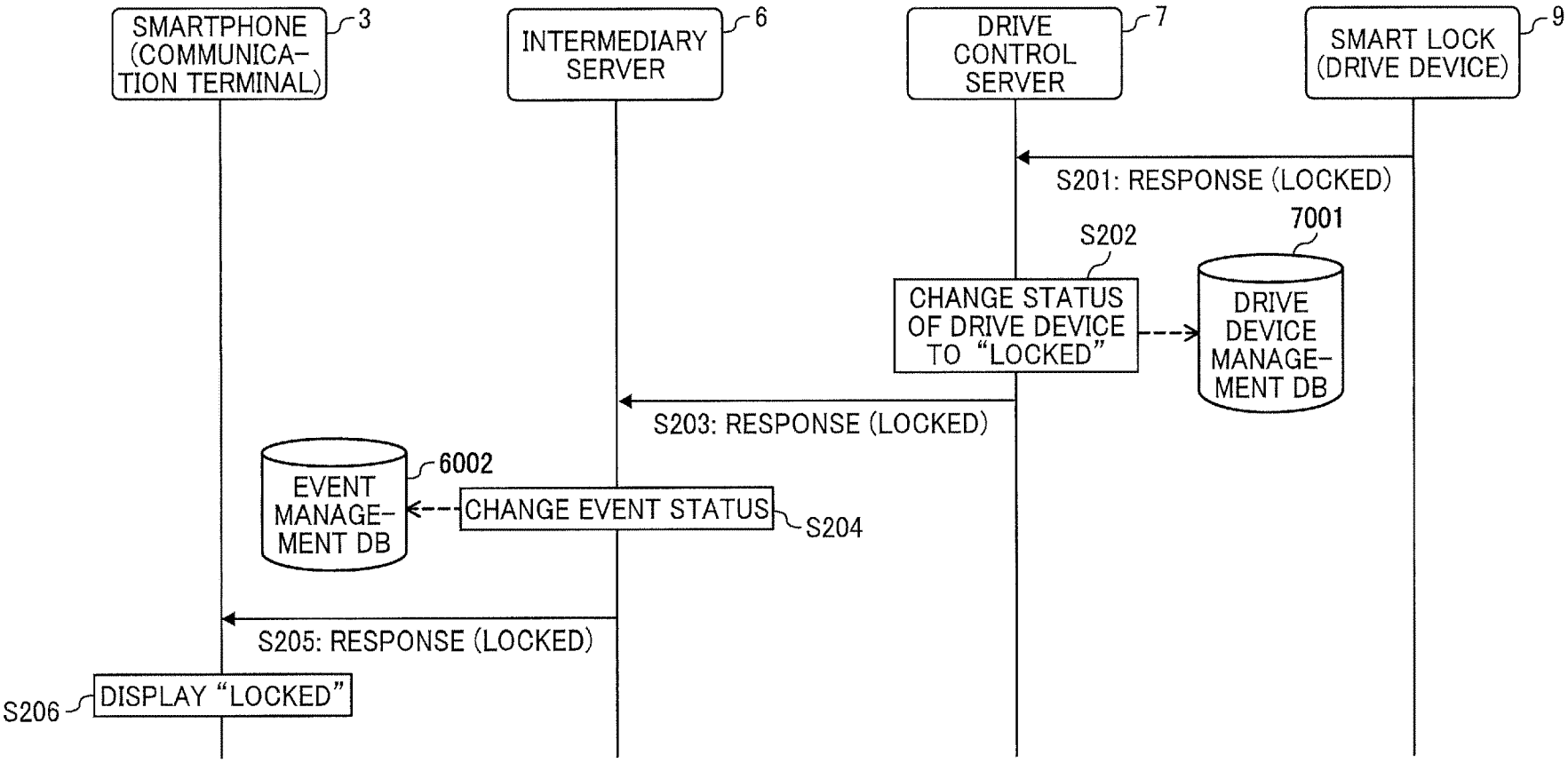
FIG. 24 is another sequence diagram illustrating a remote locking process when a key type is indicated as "ELECTRONIC KEY", according to one or more embodiments of the disclosure.

Remote Locking Process in Case of Electronic Key:

A description is given below of a remote locking process with "ELECTRONIC KEY" with respect to the smart lock 9 with reference to FIG. 23 to FIG. 24. FIG. 23 and FIG. 24 are sequence diagrams illustrating a remote locking process when the key type is indicated as "ELECTRONIC KEY", according to an embodiment of the present disclosure.

First, after the event ends, the reservation-making user and all the participants leave Conference Room A, and when the reservation-making user (User A) presses the "End" button 413 illustrated in FIG. 22C, the reception unit 32 receives the locking of the drive device and the end of the event (S181).

Next, the data transmission/reception unit 31 transmits a lock request for the smart lock 9 and an event end request to the intermediary server 6, as illustrated in FIG. 23 (S182). The lock request and the end request include the reservation ID received in step S182. Then, the data transmission/reception unit 61 of the intermediary server 6 receives the lock request and the end request.

Next, the storing/reading unit 69 of the intermediary server 6 searches the event management DB 6002 using the reservation ID received in step S182 as a search key to read the corresponding resource ID (S183).

Next, the storing/reading unit 69 searches the key type management DB 6003 using the resource ID read in step S183 as a search key to read the corresponding drive device ID and access location information (S184). Then, the data transmission/reception unit 61 transmits a remote control start request for the smart lock 9 to the drive control server 7 indicated by the access location information (S185). The request includes the drive device ID read in step S184. Then, the data transmission/reception unit 71 of the drive control server 7 receives the remote control start request.

Next, the storing/reading unit 79 of the drive control server 7 searches the drive device management DB 7001 using the driving device ID received in step S185 as a search key to read the corresponding drive device destination information (for example, IP address) (S186). Then, the data transmission/reception unit 71 transmits a lock request to the smart lock 9 indicated by the drive device destination information read in step S186 (S187). Then, the data transmission/reception unit 91 of the smart lock 9 receives the lock request.

Next, the drive control unit 92 of the smart lock 9 drives the unlocking/locking device 905 to lock (S188). As a result, the smartphone 3 remotely locks the smart lock 9 via the intermediary server 6 and the drive control server 7.

Subsequently, as illustrated in FIG. 24, the data transmission/reception unit 91 of the smart lock 9 transmits a response indicating that locking is completed to the drive control server 7 (S201). Then, the data transmission/reception unit 71 of the drive control server 7 receives the response.

Next, the storing/reading unit 79 of the drive control server 7 changes "status of drive device" in the record including the drive device ID received in step S185 from "unlocked" to "locked". (S202). Then, the data transmission/reception unit 71 of the drive control server 7 transmits a response indicating that locking is completed to the intermediary server 6 (S203). Then, the data transmission/reception unit 81 of the intermediary server 6 receives the response.

Next, the storing/reading unit 69 of the intermediary server 6 changes "event status" in the record including the reservation ID received in step S182 from "event has started" to "event ends". (S204). Then, the data transmission/reception unit 61 of the intermediary server 6 transmits a response indicating that locking is completed to the smartphone 3 (S205). Then, the data transmission/reception unit 31 of the smartphone 3 receives the response.

Next, the display control unit 34 of the smartphone 3 causes the display 318 to display a message indicating that locking is completed. The display control unit 34 of the smartphone 3 causes the display 318 to display the "End" button 413. In addition to sound indicating locking of the smart lock 9, the "End" button 413 being displayed allows the reservation-making user (User A) to know locking is completed.

As described above, according to the present embodiment, the intermediary server 6 mediates between a reservation management server 5, which manages the resource reservations received from the PC 2 used to registers a reservation, and the drive control server 7, which remotely controls the smart lock 9 for unlocking the resource. Accordingly, the intermediary server 6 provides the PC 2 with the authentication information required for unlocking the smart lock 9 used for unlocking the reserved resource. This reduces complicated processes for the reservation-making user (user).

QR CODE is an example of an information representing item. In addition to QR CODE, examples of the information representing thing item include an Integrated Circuit (IC) tag and a beacon transmitter.

When the information representing item is an IC tag, the acquisition unit 33 of the smartphone 3 is implemented by the processing of the CPU 301 with respect to the short-range communication circuit 320, but not by the processing of the CPU 301 with respect to the imaging element I/F 314. A resource ID and access destination information are acquired by short-range communication technology such as Near Field Communication (NFC) (registered trademark) and Bluetooth (registered trademark) (see S121). Since the IC tag is attached to a structure such as the door 8, the IC tag and the resource are associated with each other.

In addition, when the information representing item is a beacon transmitter, the acquisition unit 33 of the smartphone 3 is implemented by the processing of the CPU 301 with respect to the short-range communication circuit 320, but not by the processing of the CPU 301 with respect to the imaging element I/F 314. When entering a radio wave area of the beacon transmitter, the smartphone 3 acquires a resource ID and access destination information by the radio wave transmitted from the beacon transmitter (see S121). Since the beacon transmitter is attached to a structure such as the door 8, the beacon transmitter and the resource are associated with each other.

In the above description of the embodiment, the example cases in each of which a QR CODE sticker, an IC tag, or a beacon transmitter is attached to the door 8 of a conference room are given, but the present disclosure is not limited to this. For example, instead of the door 8, a structure such as a wall portion other than the door of the conference room in which the door 8 is installed may be used to be attached.

Further, in the above description of the embodiment, a conference room which is a shared resource is used as an example of a resource, but the present disclosure is not limited to this. For example, as another example of the resource, a shared mobile body such as an aircraft, a vehicle, or a ship may be used. Further, the smart lock 9 may not be attached to the outer surface of the door and may be a part of the mechanism inside the door. For example, a mechanism of the smart lock 9 may be set in a door of a vehicle to be used for a car sharing service.

Further, in the above description of the embodiment, the case where the remote control system remotely controls unlocking and locking, but the present disclosure is not limited this. For example, at least one of unlocking and locking may be remotely controlled.

Each of the above-described hardware components including the CPU 201, the CPU 301, the CPU 501, the CPU 601, and the CPU 701 may be a single unit or a plurality of units.

Each of the functions of the described embodiments may be implemented by one or more processing circuits or circuitry. Here, the "processing circuit" in the present embodiment includes a processor programmed to execute each function by software, such as a processor implemented by an electronic circuit, and devices such as an application specific integrated circuit (ASIC), a digital signal processor (DSP), a field programmable gate array (FPGA), a system on a chip (SOC), a graphics processing unit (GPU), and a conventional circuit module designed to execute each function described above.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

In a conventional technology, when a resource is a shared property, which is shared resource, shared by a plurality of users, a resource reservation is often registered and managed in advance in a reservation management service (system) in order to make effective use of the shared resource. However, this does not mean that a smart lock of the resource is remotely controlled by the reservation management service. In a case that a user is required to unlock or lock a smart lock of the reserved resource for using the reserved resource by using electronic information, the user is required to obtain the electronic information, such as a passcode used to unlock the reserved resource, from another system that remotely control the smart lock while making a reservation for the resource with the reservation management service. That is, in such a conventional technology, the user is required to perform complicated processes.

According to the above-described embodiment of the disclosure, the intermediary server mediates the reservation management server, which manages a reservation for a resource received from the registration terminal that registers the reservation, and the drive control server, which remotely controls the drive device for unlocking the resource. Due to this, the intermediary server is able to provide the registration terminal with authentication information required to cause the drive device to unlock the reserved resource. This reduces complicated processes for the reservation-making user (user).

The invention claimed is:

1. An intermediary server, comprising:

a memory stores resources and resource entry types associated with the resources, the resource entry types including an electronic key entry and a physical key entry; and circuitry electrically coupled to the memory, the circuitry configured to receive, from a reservation management server, resource identification information for identifying a resource, the reservation management server being configured to manage a reservation for the resource and to receive the reservation from a registration terminal that registers the reservation, determine, in response to receiving the resource identification information, whether a resource entry type of a corresponding resource is the electronic key entry or the physical key entry, by referring to the memory, upon determining, the resource entry type is the electronic key entry, (i) transmit, to a drive control server, drive device identification information for identifying a drive device corresponding to the received resource identification information, the drive control server being configured to remotely control the drive device to be used to unlock the resource, (ii) receive, from the drive control server, authentication information to be used to unlock the resource with the drive device identified by the drive device identification information, and (iii) transmit, to the registration terminal, the authentication information, and upon determining the resource entry type is the physical key entry, transmit information of a physical key, to the registration terminal.

2. The intermediary server of claim 1, wherein the circuitry is further configured to determine whether to transmit the drive device identification information to the drive control server depending on the resource entry type associated with the resource identification information.

3. The intermediary server of claim 2, wherein the electronic key type indicates that the drive device is remotely controlled to unlock the resource using an electronic key, and wherein the circuitry is configured to transmit the drive device identification to the drive control server, upon determining the resource entry type is the electronic key entry.

4. The intermediary server of claim 3, wherein the circuitry is configured to transmit, to a communication terminal, a resource name corresponding to the resource identification information, the communication terminal being configured to acquire the resource identification information, based on information indicating an item associated with the resource.

5. The intermediary server of claim 4, wherein the circuitry is configured to receive, from the communication terminal, user identification information for identifying a user of the communication terminal, and transmit, to the communication terminal, information on a scheduled start time and end time for usage of the resource reserved by the user that is identified by the user identification information.

6. The intermediary server of claim 5, wherein the circuitry is configured to receive, from the communication terminal, the authentication information and reservation identification information for identifying the reservation, and transmit, to the drive control server, the authentication information and the drive device identification information corresponding to the reservation identification information.

7. The intermediary server of claim 6, wherein the circuitry is configured to receive, from the drive control server, an unlocking completion notification, the unlocking completion notification being transmitted after the drive control server remotely controls the drive device for unlocking the resource and the unlocking of the resource is completed, and transmit, to the communication terminal, information indicating the unlocking completion notification.

8. A remote control system, comprising:

a drive device configured to be remotely controlled by a drive control server and to be used to unlock a resource; and an intermediary server, the drive device including drive device circuitry, the drive device circuitry being configured to unlock the resource based on authentication information, in response to a request to unlock the resource, and the request being transmitted from the drive control server, the intermediary server including a memory and intermediary server circuitry electrically coupled to the memory, the memory storing resources and resource entry types associated with the resources, the resource entry types including an electronic key entry and a physical key entry, and the intermediary server circuitry being configured to receive, from a reservation management server, resource identification information for identifying the resource, the reservation management server being configured to manage a reservation for the resource and to receive the reservation from a registration terminal that registers the reservation, determine, in response to receiving the resource identification information, whether a resource entry type of a corresponding resource is the electronic key entry or the physical key entry, by referring to the memory, upon determining the resource entry type is the electronic key entry, (i) transmit, to the drive control server, drive device identification information for identifying the drive device corresponding to the received resource identification information, the drive control server being configured to remotely control the drive device to be used to unlock the resource, (ii) receive, from the drive control server, authentication information to be used to unlock the resource with the drive device identified by the drive device identification information, and (iii) transmit, to the registration terminal, the authentication information, and upon determining the resource entry type is the physical key entry, transmit information of a physical key, to the registration terminal.

9. A mediating method, comprising:

receiving, from a reservation management server, resource identification information for identifying a resource, the reservation management server managing a reservation for the resource and receiving the reservation from a registration terminal that registers the reservation;

determining, in response to receiving the resource identification information, whether a resource entry type of a corresponding resource is an electronic key entry or a physical key entry, by referring to a memory, the memory storing resources and resource entry types associated with the resources, and the resource entry types including the electronic key entry and the physical key entry;

upon determining the resource entry type is the electronic key entry, (i) transmitting, to a drive control server, drive device identification information for identifying a drive device corresponding to the resource identification information, the drive control server remotely control the drive device to be used to unlock the resource; (ii) receiving, from the drive control server, authentication information to be used to unlock the resource with the drive device identified by the drive device identification information, and (iii) transmitting, to the registration terminal, the authentication information; and upon determining the resource entry type is the physical key entry, transmitting information of a physical key, to the registration terminal.

* * * * *